US008437678B2

(12) United States Patent
Hagiwara et al.

(10) Patent No.: US 8,437,678 B2
(45) Date of Patent: May 7, 2013

(54) IMAGE FORMING APPARATUS AND IMAGE FORMING SYSTEM

(75) Inventors: Kazunari Hagiwara, Yokohama (JP); Norio Takahashi, Suntou-gun (JP); Katsuhiro Sakaizawa, Numazu (JP); Rie Endo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 504 days.

(21) Appl. No.: 12/552,892

(22) Filed: Sep. 2, 2009

(65) Prior Publication Data

US 2010/0061749 A1 Mar. 11, 2010

(30) Foreign Application Priority Data

Sep. 5, 2008 (JP) ..... 2008-228322

(51) Int. Cl.
*G03G 21/00* (2006.01)

(52) U.S. Cl.
USPC ..... 399/350; 399/274; 399/284

(58) Field of Classification Search ..... 399/350, 399/274, 284
See application file for complete search history.

(56) References Cited

U.S. PATENT DOCUMENTS

| | | | | |
|---|---|---|---|---|
| 6,278,849 | B1 * | 8/2001 | Kawasaki | 399/55 |
| 2003/0053809 | A1 * | 3/2003 | Ogata et al. | 399/12 |
| 2003/0099477 | A1 * | 5/2003 | Shimmura | 399/57 |
| 2008/0025735 | A1 * | 1/2008 | Odani | 399/12 |

FOREIGN PATENT DOCUMENTS

| | | | |
|---|---|---|---|
| JP | 2002-365904 | A | 12/2002 |
| JP | 2006-163118 | A | 6/2006 |

* cited by examiner

*Primary Examiner* — Walter L Lindsay, Jr.
*Assistant Examiner* — Roy Y Yi
(74) *Attorney, Agent, or Firm* — Canon USA Inc IP Division

(57) ABSTRACT

An image forming apparatus includes a developer bearing member configured to bear a developer to develop a latent image, a developer regulating member configured to regulate an amount of the developer carried on the bearing member, a voltage application unit that can apply a plurality of direct current voltages of different values between the bearing member and the regulating member, and a current detection unit that can detect a plurality of direct currents of different values flowing in the regulating member when the voltage application unit applies the plurality of direct current voltages, wherein the image forming apparatus sets a direct current voltage value Vb applied by the voltage application unit when developing the latent image, so that the following expression is satisfied: |Vb|>|Vbmin|, where Vbmin indicates a direct current voltage value when the direct current detected by the current detection unit is a minimum value.

19 Claims, 23 Drawing Sheets

IMAGE FORMING APPARATUS AND IMAGE FORMING SYSTEM

BACKGROUND OF THE INVENTION

1. Field of the Invention

The present invention relates to an image forming apparatus and an image forming system.

2. Description of the Related Art

In a conventional developing method using mono-component toner, there is a contact developing method which employs a developing roller, i.e., a developer bearing member, having an elastic layer. A toner regulating member, i.e., a developer regulating member, is brought into contact with the developing roller, so that a layer of the developer attached to the developing roller is regulated and friction-charged. The toner regulating member is a blade-shaped member which is a sheet metal supported at one end, and the underside of the other end makes contact with the developing roller. The developer which is coated on the developer roller by the toner regulating member develops an electrostatic latent image formed on a photosensitive drum using a potential of a bias applied on the developing roller.

Further, Japanese Patent Application Laid-Open No. 2006-163118 discusses applying a voltage between the developing roller and the toner regulating member. This is to stabilize a charge amount and a layer thickness of the coating layer of the developer formed on the developing roller.

However, since the voltage is applied between the developing roller and the toner regulating member, the toner is pressed against the developing roller while passing through the toner regulating member. As a result, the toner receives stress by the applied voltage, so that the chargeability of the toner is reduced and the cohesiveness of the toner is increased. Therefore, it becomes difficult to acquire an image which is stable for a long term.

SUMMARY OF THE INVENTION

The present invention is directed to suppressing deterioration of the developer and acquiring a fine image.

Further, the present invention is directed to stabilizing the layer thickness of the developer on the developer bearing member regulated by the developer regulating member.

Furthermore, the present invention is directed to accurately notifying a user of a status of the developer between the developer bearing member and the developer regulating member.

Moreover, the present invention is directed to replenishing the developer according to the status of the developer between the developer bearing member and the developer regulating member.

According to an aspect of the present invention, an image forming apparatus includes a developer bearing member configured to bear a developer to develop a latent image formed on an image bearing member, a developer regulating member configured to regulate an amount of the developer carried on the developer bearing member, a voltage application unit that can apply a plurality of direct current voltages of different values between the developer bearing member and the developer regulating member, and a current detection unit that can detect a plurality of direct currents of different values flowing in the developer regulating member when the voltage application unit applies the plurality of direct current voltages, wherein the image forming apparatus sets a direct current voltage value Vb applied by the voltage application unit when developing the latent image, so that the following expression is satisfied: $|Vb|>|Vbmin|$, where Vbmin indicates a direct current voltage value when the direct current detected by the current detection unit is a minimum value in a case where the voltage application unit applies the plurality of direct current voltages before developing the latent image.

According to another aspect of the present invention, an image forming apparatus includes a developer bearing member configured to bear a developer to develop a latent image formed on an image bearing member, a developer regulating member configured to regulate an amount of the developer carried on the developer bearing member, a voltage application unit that can apply a plurality of direct current voltages of different values between the developer bearing member and the developer regulating member, and a current detection unit that can detect a plurality of direct currents of different values flowing in the developer regulating member when the voltage application unit applies the plurality of direct current voltages, wherein the image forming apparatus sets a direct current voltage value Vb applied by the voltage application unit when developing the latent image based on a difference D between a minimum value and a maximum value of the plurality of direct currents detected by the current detection unit in a case where the voltage application unit applies the plurality of direct current voltages before developing the latent image.

According to yet another aspect of the present invention, an image forming apparatus includes a developer bearing member configured to bear a developer to develop a latent image formed on an image bearing member, a developer regulating member configured to regulate an amount of the developer carried on the developer bearing member, a voltage application unit that can apply a plurality of direct current voltages of different values between the developer bearing member and the developer regulating member, and a current detection unit that can detect a plurality of direct currents of different values flowing in the developer regulating member when the voltage application unit applies the plurality of direct current voltages, wherein the image forming apparatus sets a direct current voltage value Vb applied by the voltage application unit when developing the latent image based on a difference Vs between direct voltage values applied by the voltage application unit when the current detection unit detects a minimum value and a maximum value of the plurality of direct currents in a case where the voltage application unit applies the plurality of direct current voltages before developing the latent image.

According to yet another aspect of the present invention, an image forming apparatus includes a developer bearing member configured to bear a developer to develop a latent image formed on an image bearing member, a developer regulating member configured to regulate an amount of the developer carried on the developer bearing member, a voltage application unit that can apply a plurality of direct current voltages of different values between the developer bearing member and the developer regulating member, and a current detection unit that can detect a plurality of direct currents of different values flowing in the developer regulating member when the voltage application unit applies the plurality of direct current voltages, wherein the image forming apparatus sets a direct current voltage value Vb applied by the voltage application unit when developing the latent image based on the following expression: Vs/D (=H), where D is a difference between a minimum value and a maximum value of the plurality of direct currents detected by the current detection unit and Vs is a difference between direct voltages values applied by the voltage application unit when the current detection unit detects a minimum value and a maximum value of the plurality of direct currents in a case where the voltage application unit applies the plurality of direct current voltages before developing the latent image.

According to yet another aspect of the present invention, an image forming apparatus or an image forming system includes a developer bearing member configured to bear a developer to develop a latent image formed on an image bearing member, a developer regulating member configured to regulate an amount of the developer carried on the developer bearing member, a voltage application unit that can apply a plurality of direct current voltages of different values between the developer bearing member and the developer regulating member, a current detection unit that can detect a plurality of direct currents of different values flowing in the developer regulating member when the voltage application unit applies the plurality of direct current voltages, and a notification unit configured to notify information related to a status of a developer between the developer bearing member and the developer regulating member based on the plurality of direct currents detected by the current detection unit.

According to yet another aspect of the present invention, an image forming apparatus includes a developer bearing member configured to bear a developer to develop a latent image formed on an image bearing member, a developer regulating member configured to regulate an amount of the developer carried on the developer bearing member, a developer containing unit configured to contain a developer to be supplied to the developer bearing member, a developer replenishment unit configured to replenish a developer to the developer containing unit, a voltage application unit that can apply a plurality of direct current voltages of different values between the developer bearing member and the developer regulating member, a current detection unit that can detect a plurality of direct currents of different values flowing in the developer regulating member when the voltage application unit applies the plurality of direct current voltages, and a replenishment control unit configured to control replenishment of a developer to the developer containing unit from the developer replenishment unit based on the plurality of direct currents detected by the current detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features and aspects of the invention will be described in detail below with reference to the drawings.

Figure 1:
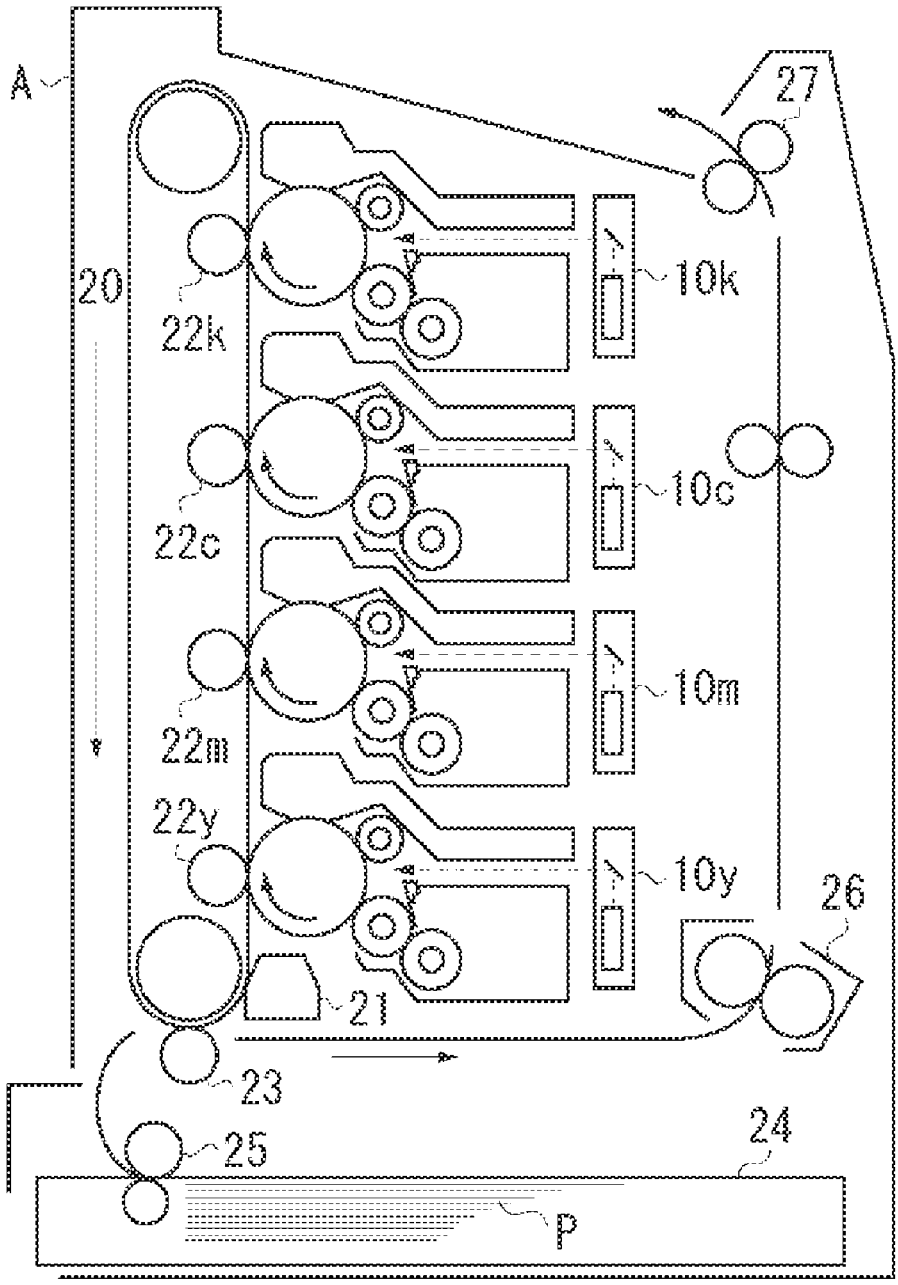
FIG. 1 illustrates a cross-sectional view of the image forming apparatus according to a first exemplary embodiment of the present invention.

FIG. 1 illustrates the cross-sectional view of the image forming apparatus according to the present exemplary embodiment. Referring to FIG. 1, an image forming apparatus A is a full color laser printer employing an electrophotographic process. A schematic configuration of the image forming apparatus A according to the present exemplary embodiment will be described below.

Figure 2:
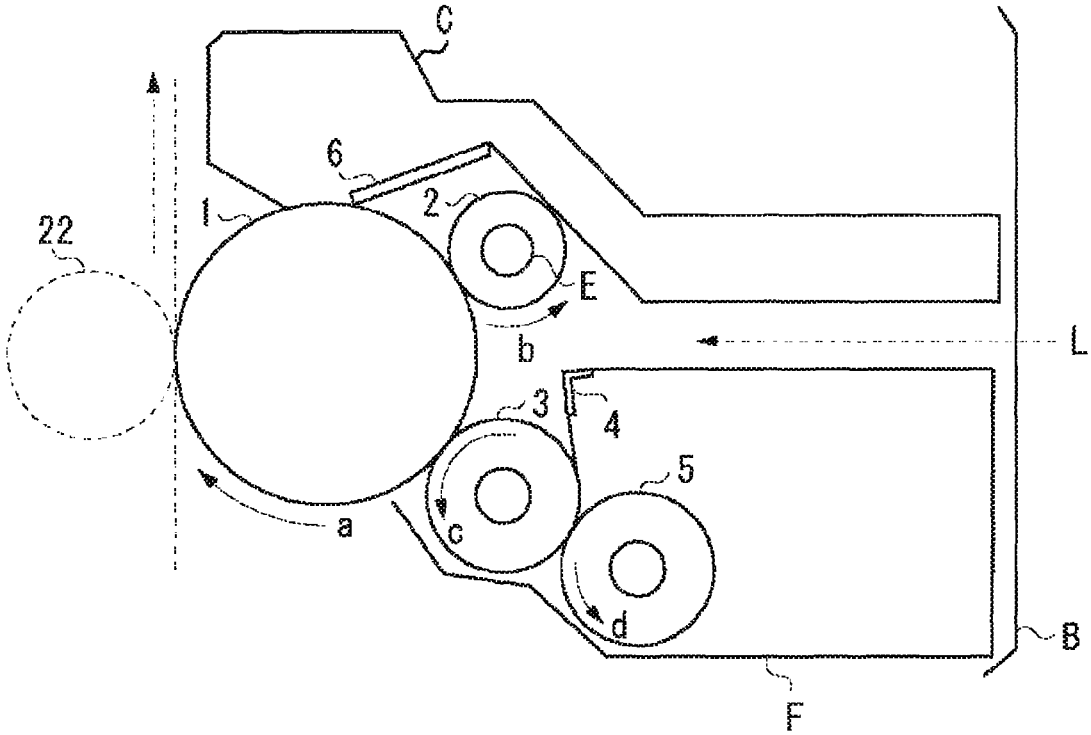
FIG. 2 illustrates a cross-sectional view of a process cartridge according to the first exemplary embodiment of the present invention.

FIG. 2 illustrates the cross-sectional view of a process cartridge B (hereinafter referred to as "cartridge B") in which a charging device E, a developing device F, a cleaning device C and a photosensitive drum 1 are integrated.

Referring to FIG. 1, the cartridges B of the colors yellow, magenta, cyan, and black, in a row of four, are arrayed in a vertical direction within the image forming apparatus A. The image forming apparatus A forms a full color image by transferring a toner image formed in the cartridge B for each color to an intermediate transfer belt 20 of a transfer device. The image forming process performed in the process cartridge B will be described below.

The toner image formed on the photosensitive drum 1 is transferred to the intermediate transfer belt 20. Primary transfer rollers 22*y*, 22*m*, 22*c*, and 22*k* are disposed in positions facing the photosensitive drum 1 of each color and sandwich the intermediate transfer belt 20. The transferred toner image is collectively transferred to a recording paper by a secondary transfer roller 23 disposed downstream in a moving direction of the intermediate transfer belt 20. The toner not transferred and remaining on the intermediate transfer belt 20 is collected by an intermediate transfer belt cleaner 21.

A recording paper P, i.e., a recording medium, is mounted on a cassette 24 in a lower unit of the image forming apparatus A. The recording paper P is conveyed by a conveyance roller 25 according to a print request. The toner image formed on the intermediate transfer belt 20 is then transferred to the recording paper P at the position of the secondary transfer roller 23.

A fixing unit 26 heat-fixes the toner image on the recording paper P. The recording paper P is then discharged to the outside of the image forming apparatus A via a paper discharge unit 27.

In the image forming apparatus A, an upper unit containing the detachable process cartridge B for each color, the transfer unit, and the lower unit containing the recording paper are separable. The user thus opens the upper and lower units to fix a paper jam or exchange the process cartridge B.

The image forming process performed by the cartridge B will be described below.

As described above, FIG. 2 illustrates the cross-sectional view of one of the four cartridges B arrayed in a vertical direction in the image forming apparatus A and its surroundings.

The photosensitive drum 1, i.e., the image bearing member, plays a central role in the image forming process. The photosensitive drum 1 is an organic photoconductive drum formed of an aluminum cylinder on which a base layer, a carrier generation layer, and a carrier transport layer are sequentially coated. In the image forming process, the image forming apparatus A drives the photosensitive drum 1 at a speed of 180 mm/sec in a direction indicated by an arrow a as illustrated in FIG. 2.

A charging roller 2, i.e., a charging device, presses a conductive rubber roller portion onto the photosensitive drum 1 and is rotationally driven in the direction of the arrow b. A direct current voltage of −1100V is applied to a core of the charging roller 2 in a charging process. The surface of the photosensitive drum 1 forms a uniform dark potential (Vd) of −550 V by the induced charge.

The uniform charge distribution surface is irradiated with a laser beam corresponding to the image data, which is output from a scanner unit 10 illustrated in FIG. 1. The surface of the photosensitive drum 1 is exposed to the laser beam as indicated by an arrow L illustrated in FIG. 2. The surface charge of the exposed portion disappears due to the carrier from the carrier generation layer, so that the potential is reduced. As a result, the electrostatic latent image in which the exposed portions have a bright potential of V1=−100 V and the non-exposed portions have a dark potential of Vd=−550 V is formed on the photosensitive drum 1.

The electrostatic latent image is developed by the developing apparatus F having the toner coating layers formed on the developing roller 3 with a predetermined coating amount and charge amount. A method for forming the toner coating layer will be described below. The developing roller 3 rotates in a forward direction as indicated by an arrow c illustrated in FIG. 2 while being in contact with the photosensitive drum 1. In the present exemplary embodiment, a direct current (DC) bias of −300 V is applied to the developing roller 3. The toner which is negatively charged by friction charging flies only to the bright potential portions owing to the potential difference at the developing unit in contact with the photosensitive drum 1. The electrostatic latent image is thus realized.

The intermediate transfer belt 20 is pressed to the photosensitive drum 1 by the primary transfer rollers 22*y*, 22*m*, 22*c*, and 22*k* that face the photosensitive drum 1. Further, direct current voltage is applied to the primary transfer rollers 22*y*, 22*m*, 22*c*, and 22*k*, and an electrical field is formed between the primary transfer rollers 22*y*, 22*m*, 22*c*, and 22*k* and the photosensitive drum 1. The toner image visualized on the photosensitive drum 1 thus receives force from the electrical field in a transfer region while in pressure contact as described above, and is transferred from the photosensitive drum 1 to the intermediate transfer belt 20. On the other hand, the toner not transferred and remaining on the photosensitive drum 1 is scraped from the drum surface by a cleaning blade 6 made of urethane rubber provided on the cleaning apparatus C, and is stored within the cleaning apparatus C.

The developing device according to the first exemplary embodiment will be described in detail below.

Figure 3:
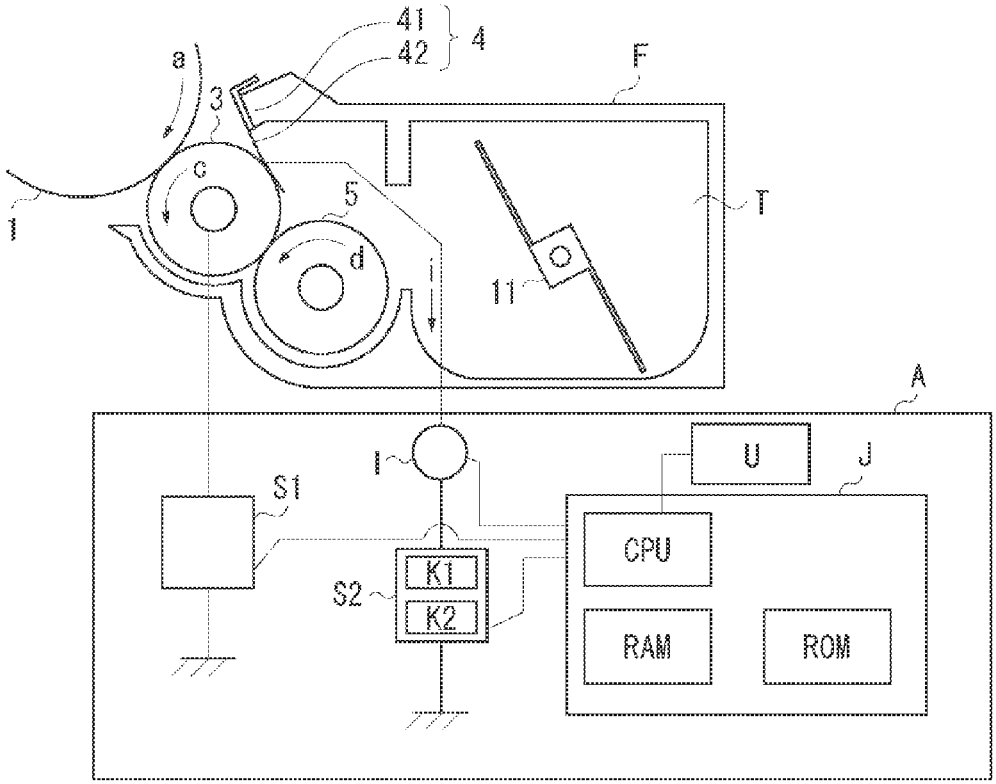
FIG. 3 illustrates the developing device and a portion of the image forming apparatus related to the developing device according to the first exemplary embodiment of the present invention.

FIG. 3 illustrates the developing device F and a portion of the image forming apparatus A related to the developing device F according to the first exemplary embodiment. The developing device F includes a developer container T, i.e., the developer containing unit, that contains the developer, the developer roller 3, a supply roller 5, a toner regulating member 4, and an agitating member 11. The developer container T contains non-magnetic mono-component toner. The developing roller 3 rotates in the forward direction as indicated by arrow c while making contact with the photosensitive drum 1. The supply roller 5 rotates in the reverse direction d while making contact with the developing roller 3. The toner regulating member 4, i.e., the developer regulating unit (developer regulating member) is in contact with the developing roller 3 downstream of the supply roller 5. The agitating member 11 agitates the toner, i.e., the developer.

The non-magnetic mono-component toner, i.e., the developer, is made by a suspension polymerization method involving binding resin and a charge-controlling agent. The toner is processed to be negatively charged by adding a fluidizer as an external additive. It is desirable to use the polymerization method to acquire high image quality.

In the present exemplary embodiment, the developing roller 3 is an elastic roller having a diameter of 16 mm, in which a conductive elastic layer of 5 mm is formed on a core having a diameter of 6 mm. A silicon rubber whose volume resistivity is $10^6$ Ωm is used for the elastic layer. A coating layer having a function of applying charge to the developer can be provided on the surface layer of the elastic roller. In the present exemplary embodiment, the elastic layer has a JIS-A hardness of 45 degrees. Further, as to the surface roughness of the developing roller 3, the arithmetic average roughness Ra is set between 0.05 to 3.0 μm. The surface roughness also depends on the granule diameter of the toner to be used. Such values are set so that the developing roller 3 elastically make contact with the photosensitive drum 1 in a stable manner. In the present exemplary embodiment, the surface roughness Ra is measured according to a definition specified by JIS-B0601 and by employing a surface roughness meter SE-30 manufactured by Kosaka Kenkyusho Co. It is desirable that the calculated mean roughness is between 0.3 to 1.0 μm.

Further, in the present exemplary embodiment, the supply roller 5 employs an elastic sponge roller having a diameter of 16 mm. 5.5 mm of polyurethane foam having a foaming structure and comparatively low hardness is formed on a core portion having a diameter of 5 mm. The supply roller 5 is configured by interconnected cell foam and can make contact with the developing roller 3 without applying a great force. The supply roller 5 supplies the toner to the developing roller 3 with appropriate unevenness on the foam surface and scrapes the remaining unused toner at the time of developing. The scrapability of the cell structure is not restricted to the urethane foam, and rubber in which a silicone rubber or ethylene-propylene-diene rubber (EPDM rubber) is foamed may be used.

Moreover, the toner regulating member 4, i.e., the developer regulating unit, which is in contact with the developing roller 3 is disposed at the downstream side of the contacting surface of the supply roller 5 and the developing roller 3 in the rotational direction c of the developing roller 3. The toner regulating member 4 controls the coating amount of the toner on the developing roller 3 and the charge amount to predetermined amounts appropriate for developing on the photosensitive drum 1. The toner regulating member 4 supports a sheet metal elastic member 42 such as a phosphor-bronze plate or a stainless plate at one end of a supporting plate 41 fixed to the developing container T. The underside of the other end is in contact with the developing roller 3. In the first exemplary embodiment, a steel plate in thickness of 1.2 mm is employed as the supporting plate 41, and the phosphor-bronze plate in thickness of 120 μm is fixedly supported on the supporting plate 41 as the sheet metal elastic member 42. A free length between the portion of the sheet metal elastic member 42 supported at one end and the portion contacting the developing roller 3 is 14 mm, and a pushing amount of the developing roller 3 with respect to the sheet metal elastic member 42 is 1.5 mm.

The portion of the image forming apparatus related to the developing device will be described below. As described above, the power source S1 applies the voltage on the developing roller 3, and the power source S2 applies the voltage on the toner regulating member 4. The value of the voltage applied by the power source S2 can be changed, and the power source S2 can apply a plurality of direct current voltages having different values. More specifically, the direct current voltage between the developing roller 3 and the toner regulating member 4 is set by adjusting the power source S2. In the present exemplary embodiment, the power source S2 includes a voltage application unit K1 and a voltage application unit K2. Further, the direct current voltage between the developing roller 3 and the toner regulating member 4 is set to apply the voltage in a direction of pressing the toner against the developing roller 3. In other words, the direct current voltage is set so that the sign of the voltage of the toner regulating member 4 which is in contact with the developing roller 3 becomes the same as the sign of the polarity of the toner. In the present exemplary embodiment, the toner, i.e., the developer, is negatively charged, and the voltage applied by the power source S1 is −300 V. The voltage supplied by the power source S2 is thus set to be a smaller value (in the negative side) than −300 V. For example, if the voltage supplied by the power source S1 is −300 V and the direct current voltage value Vb is 200 V, the voltage supplied by the power source S2 is −500 V.

On the other hand, if the toner is positively charged, the power source S2 supplies a voltage of a greater value than the voltage supplied by the power source S1. More specifically, the voltage supplied by the power source S2 is set more towards the positive side compared to the voltage supplied by the power source S1.

Further, the lifetime of the developing device F in the present exemplary embodiment including the toner capacity is set to printing 15,000 sheets of A4 size paper at 5% printing percentage.

The power sources S1 and S2 are connected to a calculation processing unit J in the image forming apparatus A. Further, the image forming apparatus A includes an ammeter I which is a current detection unit for detecting (measuring) a current Ib flowing in the regulating blade. The positive direction of the current value is indicated by an arrow i illustrated 2*n* FIG. 3. The ammeter I is also connected to the calculation processing unit J, so that the data detected by the ammeter I can be transferred to the calculation processing unit J.

Figure 4:
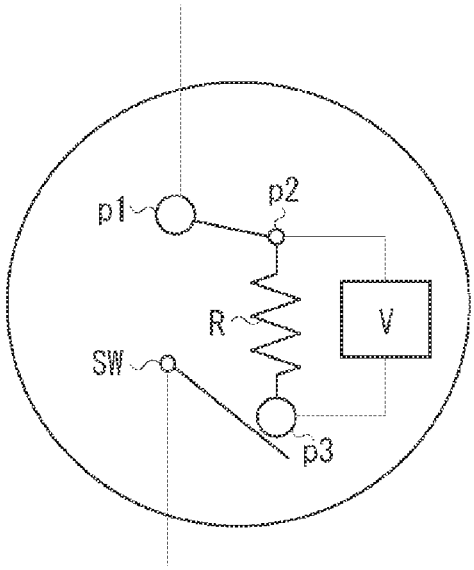
FIG. 4 is a schematic diagram illustrating the current measuring unit according to the first exemplary embodiment of the present invention.

FIG. 4 is a schematic diagram illustrating the ammeter according to the present exemplary embodiment. Referring to FIG. 4, when the ammeter I detects the current, a switch SW connects to a terminal p3, and the voltage between a terminal p2 and the terminal p3 are detected by a voltmeter V. The current value is thus detected. A resistance R of 10 kΩ is employed, and when the ammeter is not detecting a current value, the switch SW is connected to a terminal p1. The ammeter I and the switch SW are thus also connected to the calculation processing unit J. Further, the calculation processing unit J includes a central processing unit (CPU) which performs processing, a random access memory (RAM) which is a rewritable storage device that stores the detected data, and a read-only memory (ROM) which is a storage device for storing previously prepared data. The CPU, the RAM, and the ROM are set so that data can be transferred and read between each other.

Figure 5:
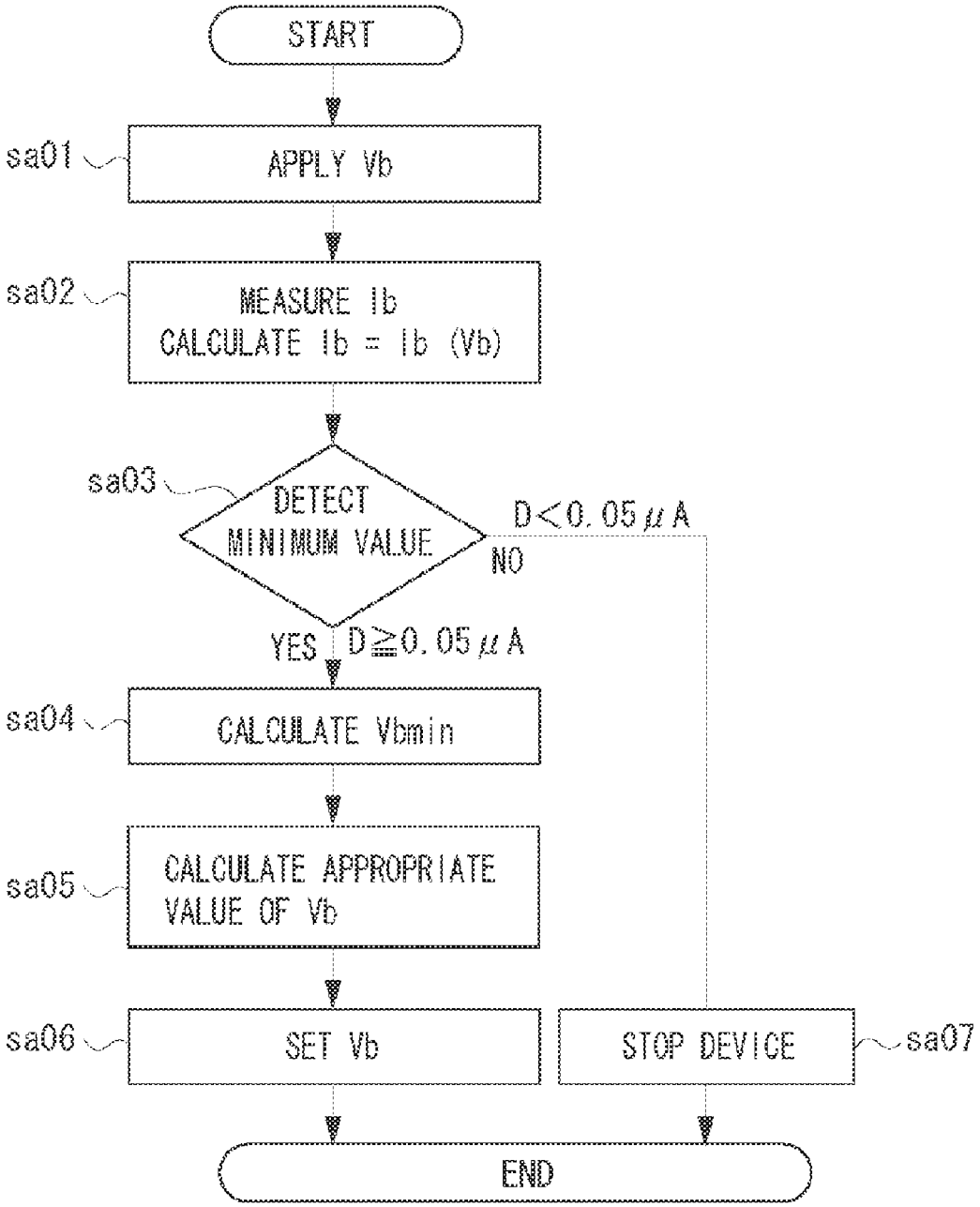
FIG. 5 is a flowchart illustrating a process of setting the direct current voltage Vb according to the first exemplary embodiment of the present invention.
Figure 6:
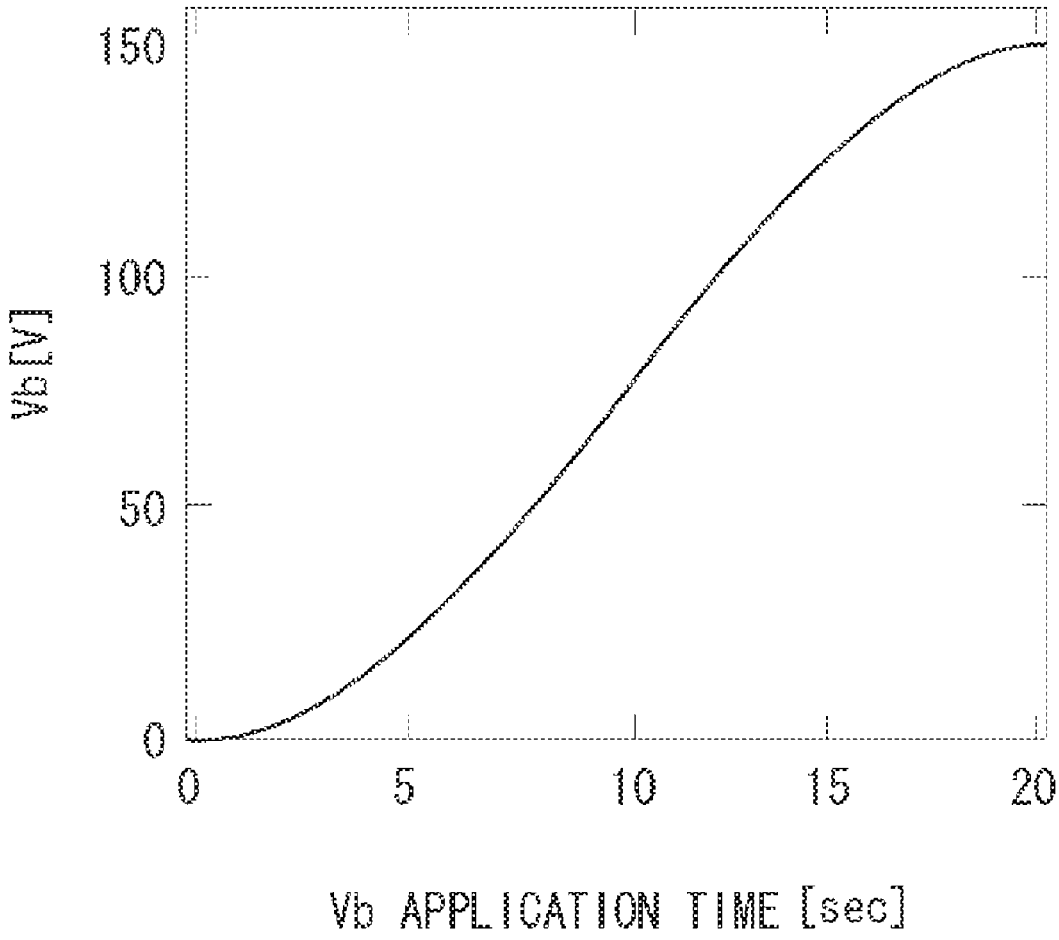
FIG. 6 illustrates a relation between an application time of the direct current voltage Vb by a power source S2 and the direct current voltage Vb.

A method for setting the direct current voltage Vb in the present exemplary embodiment will be described below. FIG. 5 is a flowchart illustrating the process of setting the direct current voltage Vb. In step sa01, the power source S2 applies the direct current voltage Vb. More specifically, as illustrated in FIG. 6, the direct current voltage Vb is changed in a sine wave form from 0 V to 150 V for approximately 20 seconds. In step sa02, the ammeter I detects the direct current Ib corresponding to the value of the direct current voltage Vb and stores the value in the RAM. The CPU then calculates the relation Ib (Vb) between the direct current voltage Vb and the direct current Ib using the direct current voltage Vb and the direct current I stored in the RAM. The CPU stores the calculated result in the RAM. Depending on the accuracy of the detector, smoothing can be performed as appropriate to minimize the effect of the range of fluctuation of the direct current Ib.

A process of detecting a minimum value of Ib (Vb) which is performed in step sa03 illustrated in FIG. 5 will be described below. In the process, the CPU calculates a current difference D which is a difference between the maximum value and the minimum value of the Ib (Vb) calculated in step sa02. If the current difference D is greater than or equal to 0.05 μA (YES in step sa03), the CPU detects the minimum value of Ib (Vb). On the other hand, if the current difference D is less than 0.05 μA (NO in step sa03), the process proceeds to step sa07. In step sa07, the device is stopped, and the process of setting the direct current voltage Vb is ended. A reason for detecting the minimum value with the current difference D will be described below.

After the CPU detects the minimum value of the direct current Ib (Vb) in step sa03, the process proceeds to step sa04. In step sa04, the CPU calculates a direct current voltage value when Ib (Vb) is the minimum value, i.e., Vbmin, and stores the result in the RAM. In step sa05, the CPU then calculates an appropriate value of the direct current voltage Vb, as will be described below. In step sa06, the calculation processing unit gives an activation instruction to the power source S2 based on the value of Vb acquired in step sa05. The power source S2 is then activated, and the direct current voltage Vb is thus set. The relation between the direct current Ib (Vb) and the direct current voltage Vb will be described below before describing in detail the process of calculating the appropriate value of the direct current voltage Vb performed in step sa05.

Figure 7:
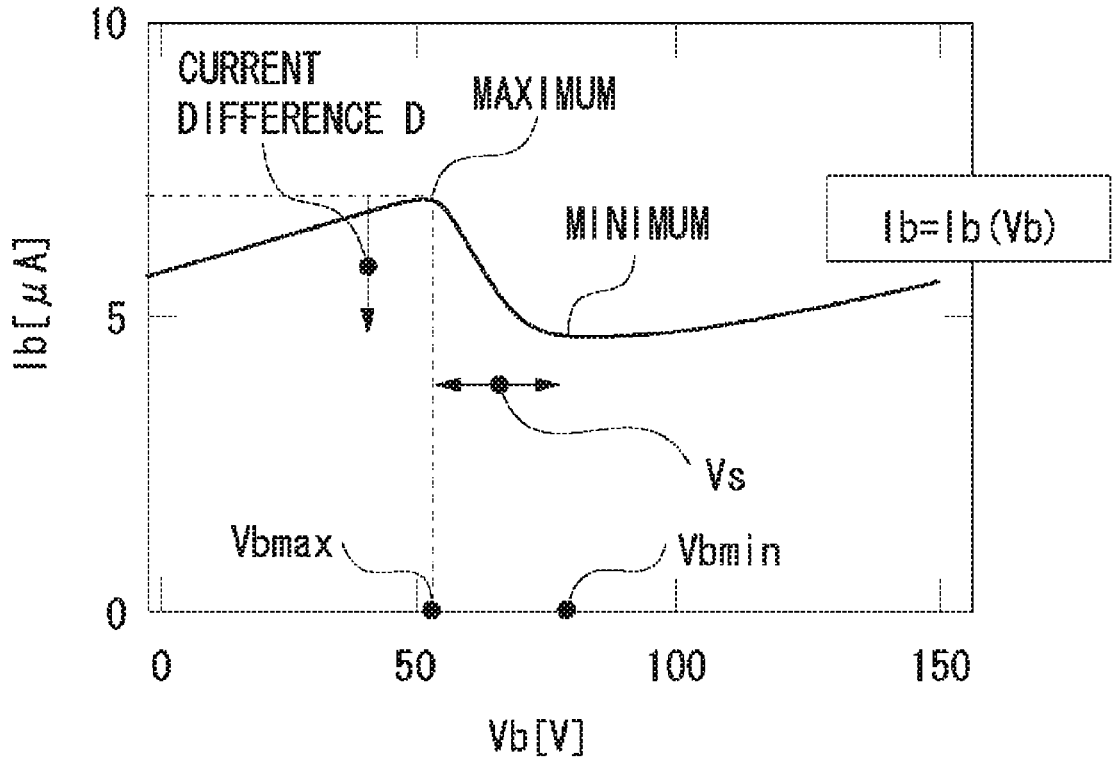
FIG. 7 illustrates a relation between an input waveform of Vb and Ib=Ib (Vb) according to the first exemplary embodiment of the present invention.

FIG. 7 illustrates an example of the relation of Ib=Ib (Vb) according to the present exemplary embodiment.

Figure 8:
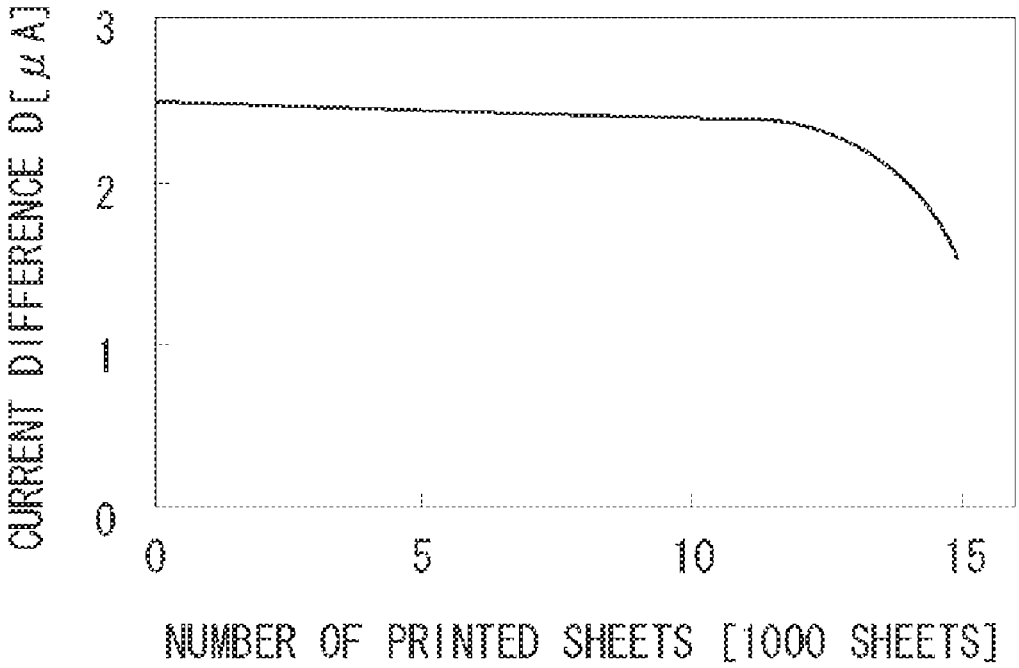
FIG. 8 illustrates a relation between the current difference D and a number of printed sheets.

Further, FIG. 8 illustrates a relation between the current difference D and the number of printed sheets. Referring to FIG. 8, studies by the inventors have shown that the value of the current difference D gradually decreases along with the number of printed sheets. The reason for this can be explained by a phenomenon as described below.

The number of times the toner makes contact with the regulating blade changes between a region in which the value of the direct current voltage Vb is less than Vbmin and a region in which the value is greater than Vbmin. The minimum value of Ib=Ib (Vb) is thus generated. The power moving the toner towards the direction of the developing roller due to the direct current voltage Vb is small in the region in which the direct current voltage Vb is less than Vbmin. As a result, the number of times the regulating blade and the toner come in contact with each other increases.

On the other hand, the power moving the toner towards the direction of the developing roller due to the direct current voltage Vb becomes large in the region where the direct current voltage Vb is greater than Vbmin. As a result, the toner is pressed against the developing roller. The number of times the regulating blade comes into contact with the toner thus decreases. When the number of times the regulating blade and the toner contact each other is great, friction charging between the toner and the regulating blade becomes more frequent. As a result, the direct current Ib flowing in the regulating blade increases. On the contrary, when the number of times the regulating blade and the toner contact each other is small, friction charging between the toner and the regulating blade becomes less frequent. Therefore, the direct current Ib decreases.

Further, when the direct current voltage Vb is set to be equal to Vbmin, irregular stripes are generated on the toner coating layer of the developing roller in the rotational direction of the developing roller. Since there is an unstable region where the toner is both easily pressed against the developing roller and not easily pressed against the developing roller by the applied voltage, the toner coating layer becomes deteriorated.

To suppress the generation of the vertical stripes, it is desirable that the direct current voltage Vb in the present exemplary embodiment is set to satisfy $|Vb|>|Vbmin|$. Further, it is more desirable for Vb to be set to satisfy $|Vb|>|Vbmin|+20V$.

Furthermore, if a value of Vo, i.e., the direct current voltage at the end of detecting Ib=Ib (Vb), is not equal to Vbmin, the generation of vertical stripes due to instability of the toner coating layer can be suppressed. In the present exemplary embodiment, the change in the toner coating layer is detected as appropriate to understand the status of the toner coating layer.

As a result, if the vertical stripes are generated when the image forming process is not being performed (during detection), it greatly affects the image forming process (i.e., a non-detection period). In other words, it is desirable to minimize the instable state of the toner coating layer during detection. Therefore, it is desirable to set Vo to satisfy $|Vo|>|Vbmin|$ in order to suppress the generation of the vertical stripes caused by instability of the toner coating layer. It is more desirable to set Vo to satisfy $|Vo|>|Vbmin|+20$ V.

Figure 9:
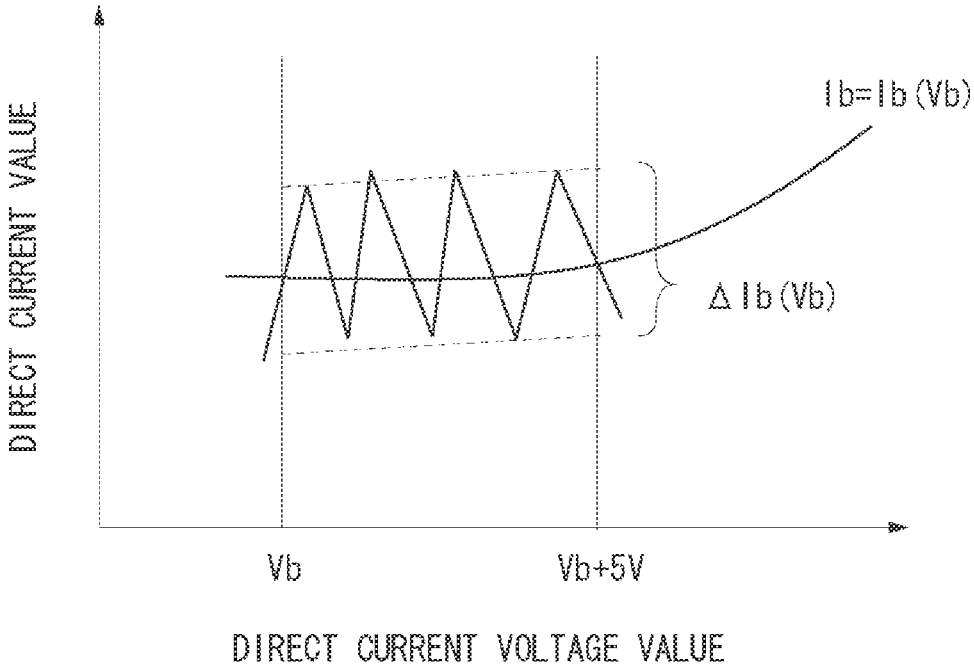
FIG. 9 illustrates a range of fluctuation of the direct current voltage value.

The range of fluctuation of the direct current Ib when detecting Ib will be described below. As illustrated in FIG. 9, in the present exemplary embodiment, a range of fluctuation ΔIb (Vb) when the direct current voltage value is Vb is between the value of Ib corresponding to Vb and the value of Ib corresponding to the direct current voltage value, approximately 5 V greater than Vb. More specifically, ΔIb (Vb) defines peak-to-peak between Vb and Vb+5V when Ib is regarded as an alternating current. However, since the range of fluctuation depends on the detection accuracy of the detection device, it is desirable to set the range of fluctuation as appropriate according to the detection accuracy of the detection device.

Further, the range of fluctuation becomes greater when the toner coating layer becomes unstable. When the value of the direct current voltage Vb is large, a discharge phenomenon locally happens between the toner, between the toner and the regulating blade, and between the toner and the developing roller. As a result, the range of fluctuation of the direct current value becomes greater along with the formation of the unstable toner coating layer. On the other hand, the toner is sufficiently pressed against the developing roller in a region where the direct current voltage value Vb satisfies $|Vbmin|\leqq|Vb|\leqq|Vbmin|+20$ V. The range of fluctuation of the direct current value is thus small and is stable.

As a result of the studies by the inventors, the toner coating layer becomes particularly unstable when $|\Delta Ib\ (Vb)|>10\times|\Delta Ib\ (Vbmin)|$, where ΔIb (Vbmin) is a range of fluctuation of the direct current when the direct current voltage Vb equals Vbmin.

Therefore, it is desirable to set the direct current voltage Vb to satisfy $|\Delta Ib\ (Vb)|\leqq 10\times|\Delta Ib\ (Vbmin)|$ to suppress the instability of the toner coating layer.

The decrease in the current difference D along with an increase in the number of printed sheets will be described below.

When the number of printed sheets increases, the toner in the developer container receives stress by sliding and rubbing with the toner supply roller, the toner regulating member, and the photosensitive drum. In such toner, the external additive becomes disengaged or embedded, and cohesiveness becomes high.

In a case where the cohesiveness of the toner is high, the mobility of each toner decreases as compared to when the cohesiveness is low. As a result, the cohesiveness of the toner does not greatly change even if sufficient electrical power is applied, so that the current difference D between the maximum value and the minimum value also becomes small. On the other hand, when the cohesiveness of the toner is low, the mobility of each toner is high. Therefore, if the electrical power is applied to press the toner against the developing roller, the cohesive state of the toner drastically changes and becomes dense. Therefore, the current difference D between the maximum value and the minimum value also increases.

As a result, it is assumed that the decrease in the current difference D along with the progress of toner deterioration is caused by the following reason. As toner deterioration progresses, immobility of the toner causes the movement of the toner to be small when the value of the direct current voltage Vb is near Vbmin.

Therefore, when detecting the minimum value of Ib (Vb) in step sa03 illustrated in FIG. 5, it is assumed that toner deterioration is progressing where the current difference D is less than 0.05 μA. The developing device is thus stopped from operating.

The process of calculating the direct current voltage Vb performed in step sa05 illustrated in FIG. 5 according to the present exemplary embodiment will be described in detail below.

Figure 10:
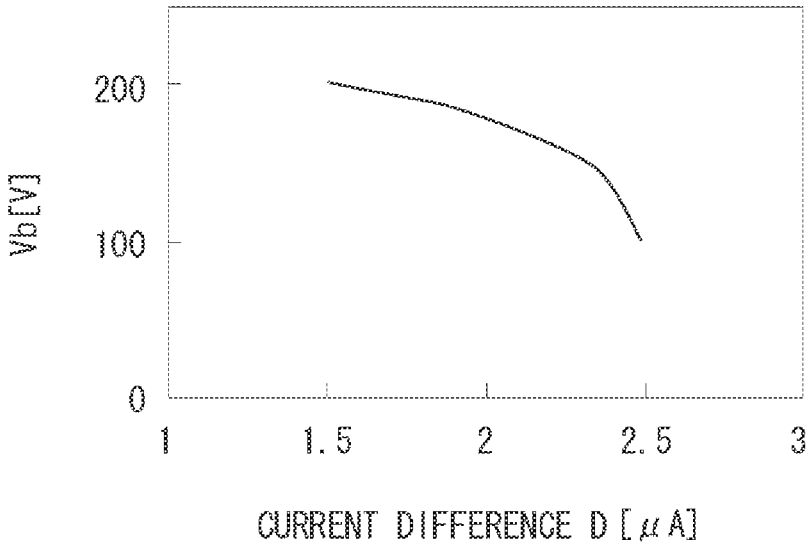
FIG. 10 illustrates a relation between the current difference D and the direct current voltage Vb appropriate for acquiring a fine image obtained calculation in Vb=Vb (D).

FIG. 10 illustrates the relation of Vb=Vb (D) in which Vb is calculated as an appropriate direct current voltage for acquiring a fine image against the current difference D. The relation indicates that |Vb| increases as D decreases. The relation of Vb=Vb (D) is previously written in the ROM.

The developing device used to calculate the relation of Vb=Vb (D) is similarly configured as the developing device of the present exemplary embodiment. The value of the appropriate direct current voltage Vb is calculated by measuring the current difference D and evaluating the image as appropriate under continuous printing at 5% image percentage.

Figure 11:
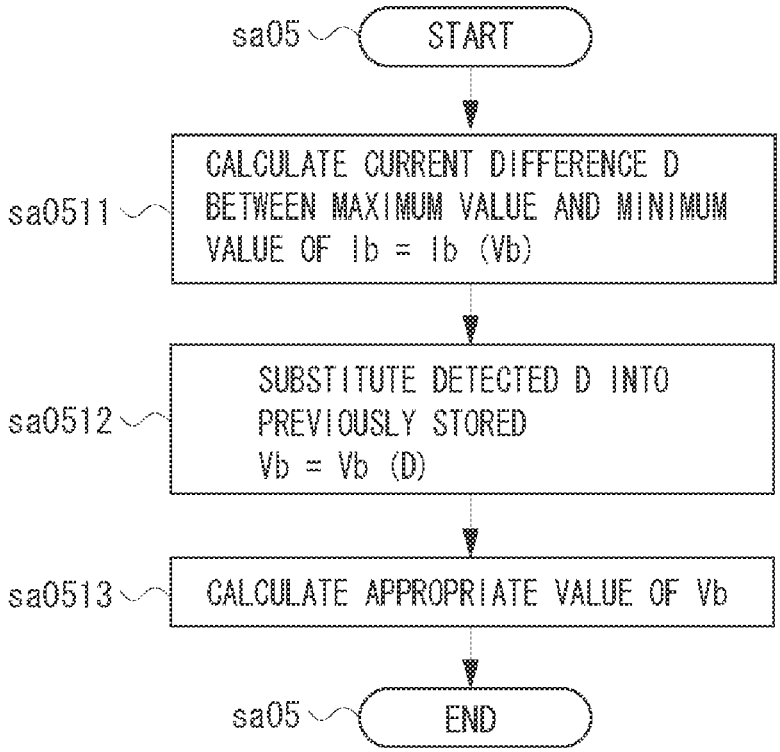
FIG. 11 is a flowchart illustrating a process of calculating the appropriate direct current voltage Vb according to the first exemplary embodiment of the present invention.

FIG. 11 is a flowchart of the process performed in step sa05. In step sa0511, the CPU reads Ib=Ib (Vb) acquired in step sa02 illustrated in FIG. 5 and previously stored in the RAM. The CPU then calculates the current difference D between the maximum value and the minimum value of the direct current Ib and stores the calculated current difference D in the RAM. In step sa0512, the CPU reads the current difference D stored in the RAM and the Vb=Vb (D) previously stored in the ROM. The CPU then compares the read current difference D and the Vb=Vb (D). In step sa0513, the CPU then calculates the appropriate value of the direct current voltage Vb. The calculation of the appropriate direct current voltage Vb in step sa05 is thus ended, and the process proceeds to step sa06.

The present exemplary embodiment further provides a process for notifying the user of information related to the status of the toner between the developing roller 3 and the toner regulating member 4 (i.e., information reflecting the progress of toner deterioration). The process of warning on and stopping the operation of the developing device in the present exemplary embodiment will be described below.

Figure 12:
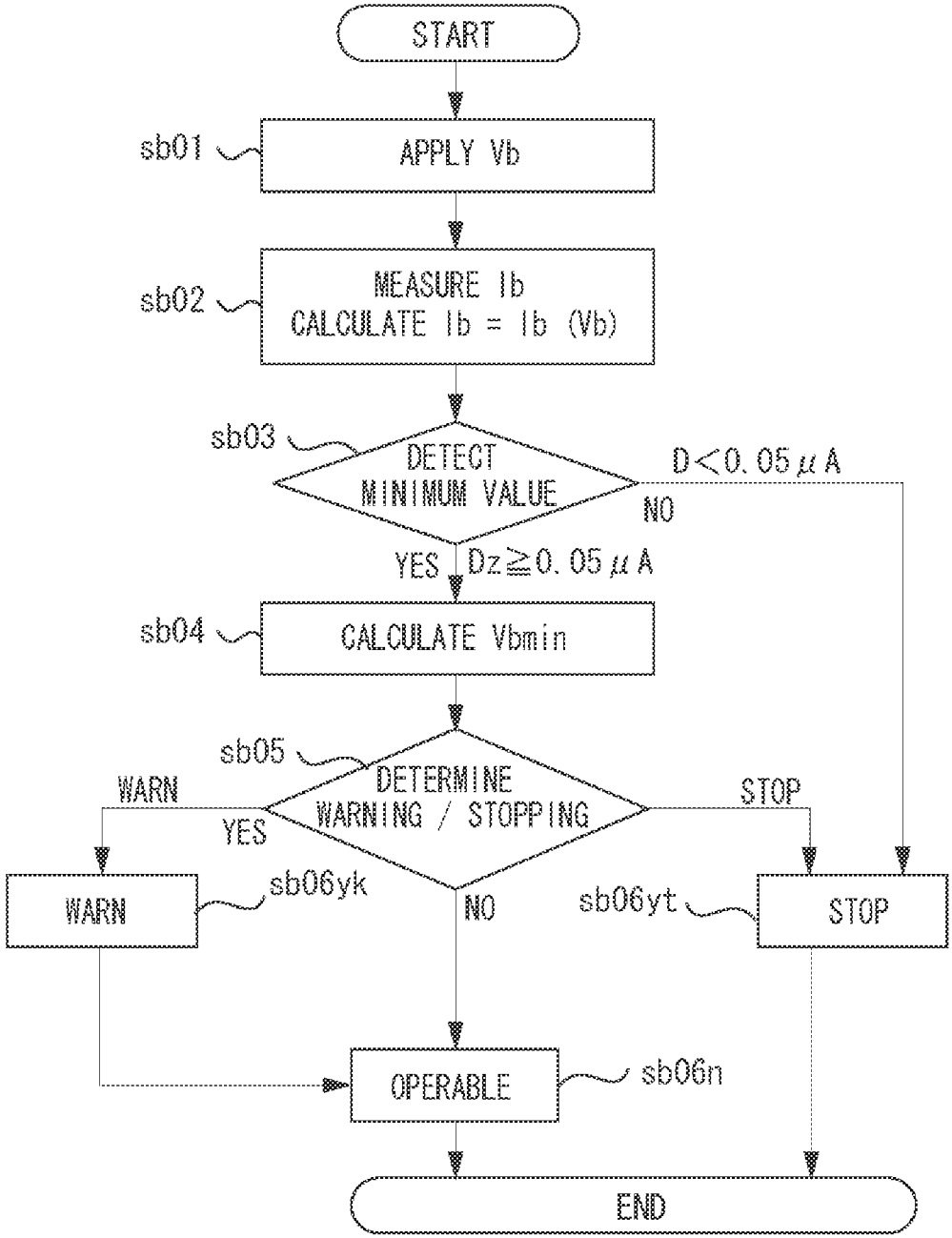
FIG. 12 is a flowchart illustrating a process of determining whether to give a warning on or stop the operation of the developing device according to the first exemplary embodiment of the present invention.

FIG. 12 is a flowchart illustrating the process of warning on and stopping the operation of the developing device. Step sb01 to step sb04 in FIG. 12 is similar to step sa01 to step sa04 in the process of setting the direct current voltage Vb illustrated in FIG. 5.

In step sb05, the CPU determines whether to warn the user on or stop the operation of the developing device as will be described below. If the CPU determines to warn the user (YES (warn) in step sb05), the process proceeds to step sb06*yk*. In step sb06*yk*, the CPU displays warning information, and the developing device continues to operate. The process of warning on and stopping the operation of the developing device is thus ended. If the CPU determines not to warn the user on or stop the operation of the developing device (NO in step sb05), the process proceeds to step sb06*n*. In sb06*n*, the developing apparatus continues to operate, and the process of warning on and stopping the operation of the developing device is thus ended.

If the CPU determines to stop the operation of the developing device (YES (stop) in step sb05), the process proceeds to step sb06*yt*. In step sb06*yt*, the developing device is stopped, and the process of warning on and stopping the operation of the developing device is thus ended.

As described above, the value of the current difference D decreases as the deterioration of the toner progresses. Therefore, when the CPU determines whether to warn on or stop the operation of the developing device, the CPU refers to a predetermined current difference value Dk previously stored in the ROM with the value of the current difference D. If the relation between D and Dk is such that D is less than or equal to Dk, the CPU warns the user on the developing device or stops the operation of the developing device.

More specifically, the appropriate predetermined values Dk1=1.7 μA (warn) and Dk2=1.5 μA (stop) for the timing of warning on and stopping the operation of the developing device are calculated using a previously prepared developing device. The calculated values are then written in the ROM. The developing device used in calculating the values of Dk1 and Dk2 is of a configuration similar to the developing device of the present exemplary embodiment. Further, the appropriate values are calculated when continuously printing at 5% image percentage, and measuring the current difference D and evaluating the image. As a result, the image forming apparatus can warn the user on or stop the operation of the developing device according to toner deterioration, so that the user can smoothly exchange the developing device and the process cartridge. Further, significant image deterioration and soiling of the image forming apparatus main assembly can be prevented.

In the present exemplary embodiment, a notification unit U which notifies the user of the developing device (i.e., warns on or stops the operation of the developing device) is disposed in the image forming apparatus A (refer to FIG. 3). However, the notification unit can be displayed on a personal commuter via a network (i.e., can be an image forming system).

Further, in the present exemplary embodiment, processes of setting the direct current voltage Vb and warning the user on and stopping the operation of the developing device are performed when the image forming process is not being performed.

More specifically, each process is performed every time 2000 sheets are printed. When the CPU warns the user in the process of warning on and stopping the operation of the developing device, each process is performed every time 1000 sheets are printed.

The period between performing each process is shortened after the image forming apparatus warns the user on the developing device. As a result, adjustment can be made as necessary in consideration of acceleration of toner deterioration.

The second exemplary embodiment of the present invention is basically similar to the first exemplary embodiment. The difference will be described below.

In the second exemplary embodiment, when the CPU calculates the appropriate value of Vb in step sa05, the CPU calculates direct current voltage values Vbmax and Vbmin corresponding to each of the maximum value and the minimum value of Ib=Ib (Vb). The CPU also calculates a voltage difference Vs between Vbmax and Vbmin. The appropriate value of the direct current voltage value Vb is then calculated from the voltage difference Vs.

Figure 13:
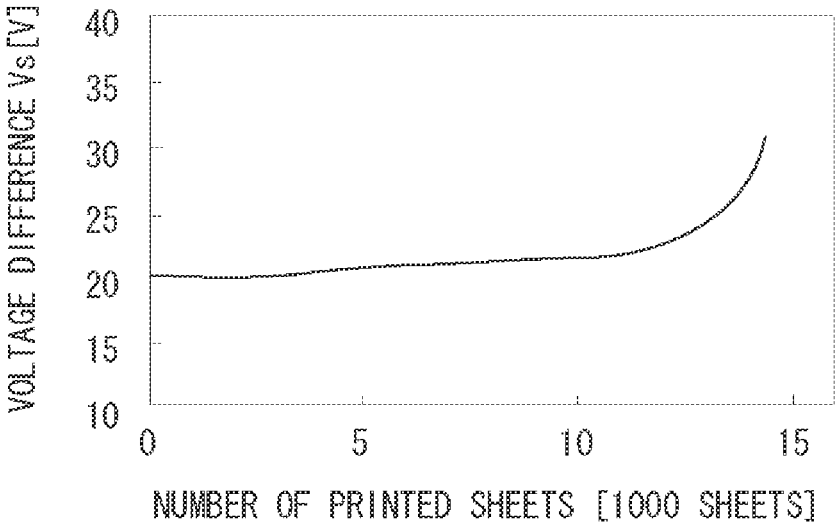
FIG. 13 illustrates a relation between the voltage difference Vs and the number of printed sheets.

As illustrated in FIG. 7, the voltage difference Vs is a change amount of the direct current voltage when the current difference D is generated. The inventors have discovered that the value of Vs increases as the number of printed sheets increases, as illustrated in FIG. 13. In other words, the voltage difference Vs is a value related to toner deterioration.

As described above, as toner deterioration progresses and the cohesiveness of the toner become high, each of the toner particles becomes immobile. In such a case, a greater electrical force, i.e., the direct current voltage Vb, becomes necessary to sufficiently press the toner against the developing roller. More specifically, when the mobility of the toner is reduced, it becomes difficult to press the toner against the developing roller using the direct current voltage Vb. The voltage difference Vs between Vbmax and Vbmin thus becomes large. As a result, the voltage difference Vs increases along with an increase in the number of printed sheets.

The process of calculating the direct current voltage Vb performed in step sa05 illustrated in FIG. 5 according to the second exemplary embodiment will be described in detail below.

Figure 14:
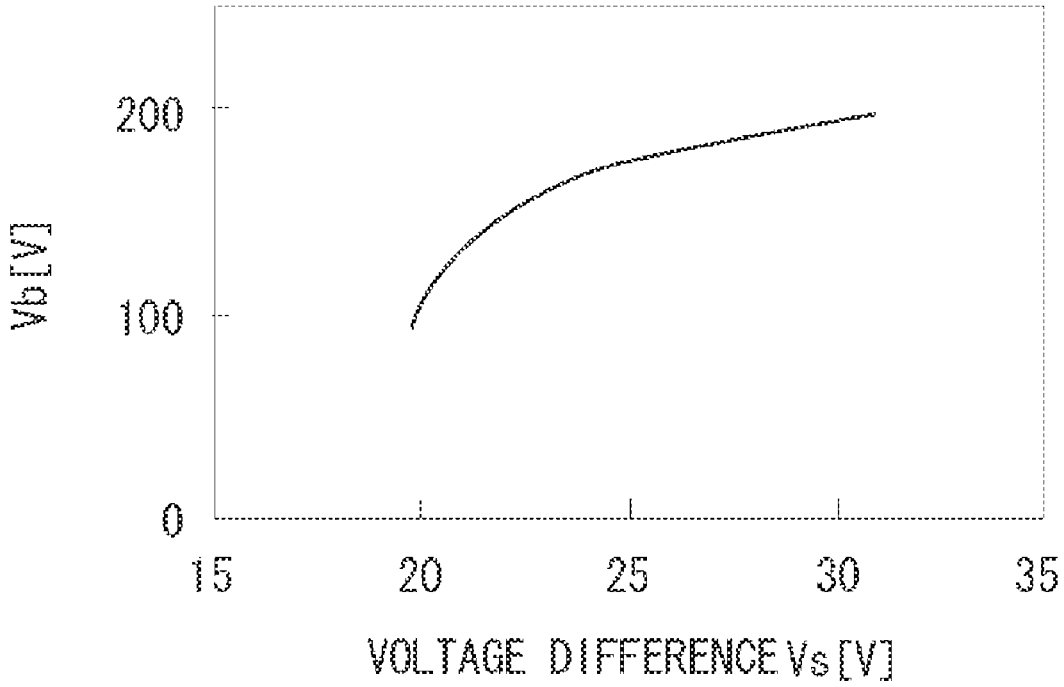
FIG. 14 illustrates a relation between the voltage difference Vs and the direct current voltage Vb appropriate for acquiring a fine image obtained by calculation in Vb=Vb (Vs).

FIG. 14 illustrates a relation between the value of Vs and the appropriate direct current voltage Vb for acquiring a fine image as Vb=Vb (Vs). Referring to FIG. 14, |Vb| increases as Vs increases.

The relation of Vb=Vb (Vs) is previously written in the ROM.

The developing device used in calculating the relation of Vb=Vb (Vs) is of a configuration similar to the developing device of the present exemplary embodiment. Further, the appropriate value of the direct current voltage Vb is calculated by measuring the voltage difference Vs and evaluating the image when continuously printing at 5% image percentage.

Figure 15:
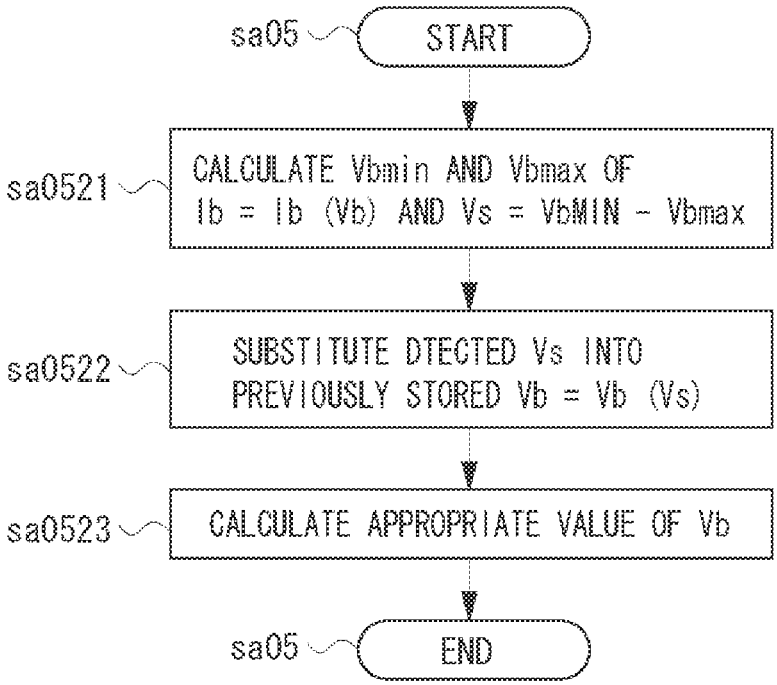
FIG. 15 is a flowchart for calculating the appropriate direct current voltage Vb according to a second exemplary embodiment of the present invention.

FIG. 15 is a flowchart illustrating the process of step sa05 according to the second exemplary embodiment. In step sa0521, the CPU reads Ib=Ib (Vb) detected in step sa02 and stored in the RAM. The CPU then calculates the voltage difference Vs between the direct current voltages Vbmax and Vbmin corresponding to the maximum and minimum values of the direct current Ib respectively (i.e., Vs=Vbmax−Vbmin). The CPU then stores the calculated Vs in the RAM. In step sa0522, the CPU reads the voltage difference Vs stored in the RAM and the relation Vb=Vb (Vs) previously stored in the ROM. The voltage difference Vs is then compared with the relation Vb=Vb (Vs). In step sa0523, the appropriate value of the direct current voltage Vb is calculated. The process of calculating the appropriate direct current voltage Vb in step sa05 is then ended, and the process proceeds to step sa06.

Further, in the second exemplary embodiment, the process of warning on and stopping the operation of the developing device of step sb05 is different. In step sb02, the CPU reads the relation Ib=Ib (Vb) stored in the RAM. The CPU then calculates the voltage difference Vs between the direct current voltages Vbmax and Vbmin corresponding to the maximum and minimum values of the direct current Ib respectively (i.e., Vs=Vbmax−Vbmin). The CPU then compares the Vs with the predetermined value Vsk previously stored in the ROM, and when Vs is greater than or equal to Vsk, the CPU gives a warning on or stops the operation of the developing device. More specifically, appropriately predetermined values Vsk1=28 V (for warning) and Vsk2=30 V (for stopping) are calculated for warning and stopping timing by using a previously prepared developing device. The calculated values are then written in the ROM. The developing device for calculating the values of Vsk1 and Vsk2 is of a configuration similar to the developing device of the present exemplary embodiment. Further, the appropriate values are calculated by measuring the voltage difference Vs and evaluating the image when continuously printing at 5% image percentage.

The third exemplary embodiment of the present invention is basically similar to the first exemplary embodiment. The difference will be described below.

Figure 16:
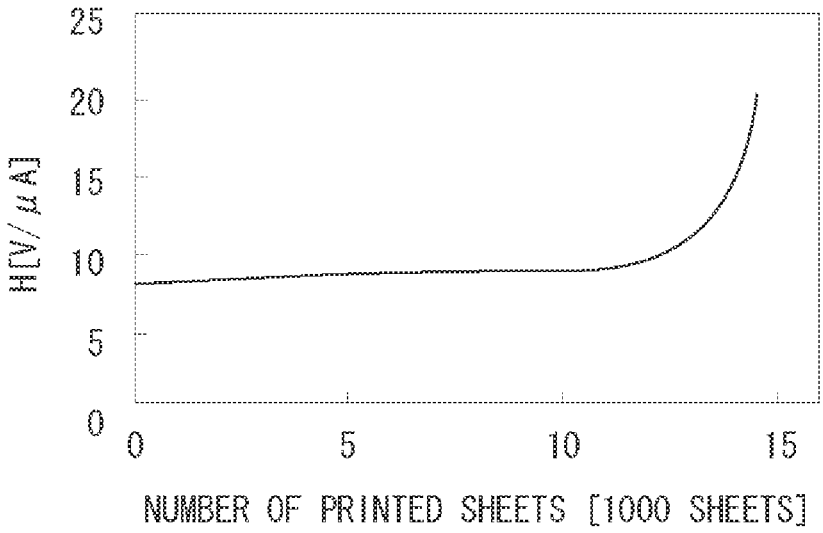
FIG. 16 illustrates a relation between a ratio H of the current difference D to the voltage difference Vs and the number of printed sheets according to a third exemplary embodiment of the present invention.

When the CPU calculates the appropriate value of Vb in step sa05 in the third exemplary embodiment, the CPU uses a ratio H of the current difference D to the voltage difference Vs. As illustrated in FIG. 16, since the value of H increases as the number of printed sheets increases, H is a value reflecting toner deterioration.

Further, the ratio H is acquired by dividing the voltage difference Vs which increases as toner deterioration progresses, by the current difference D which decreases as toner deterioration progresses. As a result, the ratio H also increases as toner deterioration progresses. However, the value of ratio H is less dispersed as compared to the singularly detected current difference D and the voltage difference Vs, and can thus be used to accurately determine the degree of toner deterioration.

The process of calculating the direct current voltage Vb performed in step sa05 according to the third exemplary embodiment will be described in detail below.

Figure 17:
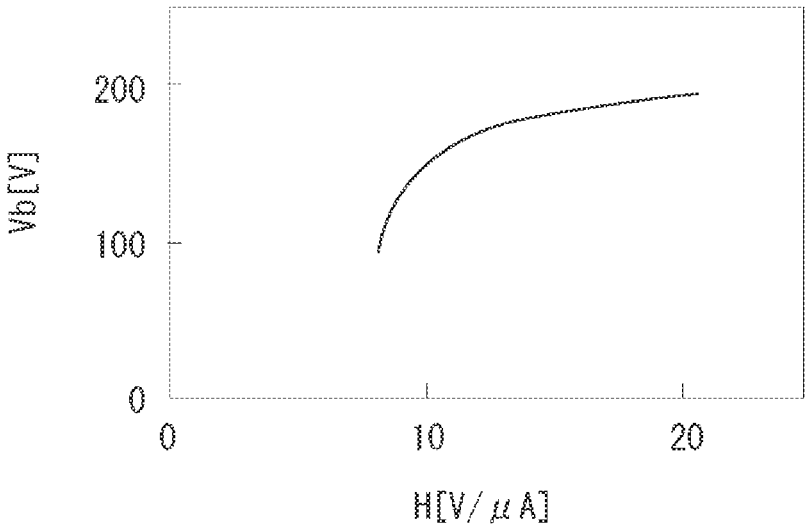
FIG. 17 illustrates a relation between the value H and the direct current voltage Vb appropriate for acquiring a fine image by calculating Vb=Vb (H.

FIG. 17 illustrates a relation between the value of H and the appropriate direct current voltage Vb for acquiring a fine image as Vb=Vb (H). Referring to FIG. 17, |Vb| increases as H increases.

The relation of Vb=Vb (H) is previously written in the ROM.

The developing device used in calculating the relation of Vb=Vb (H) is of a configuration similar to the developing device of the present exemplary embodiment. Further, the appropriate value of the direct current voltage Vb is calculated by measuring the ratio H and evaluating the image when continuously printing at 5% image percentage.

Figure 18:
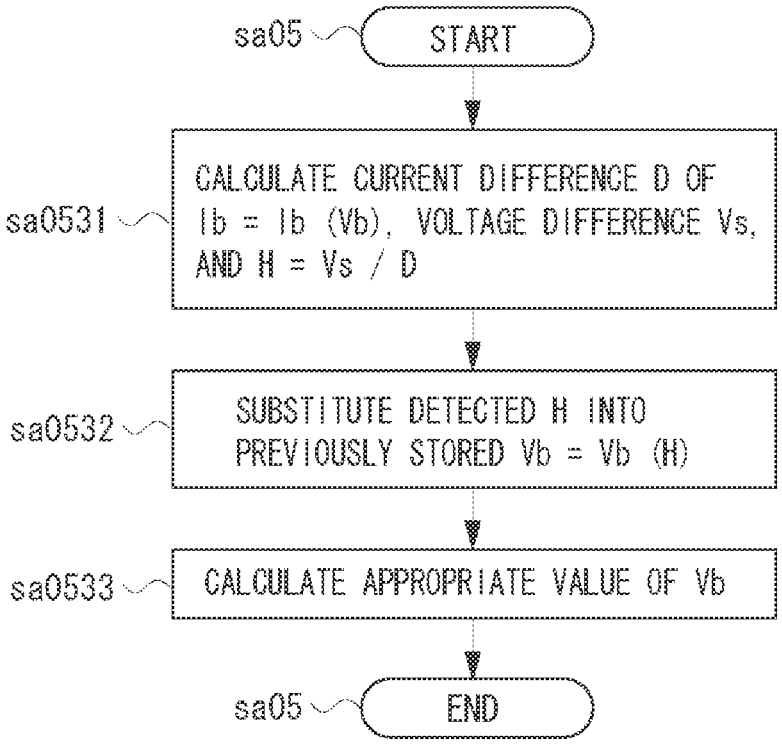
FIG. 18 is a flowchart illustrating a process of calculating the appropriate direct current voltage Vb according to the third exemplary embodiment of the present invention.

FIG. 18 is a flowchart illustrating the process of step sa05 according to the third exemplary embodiment. In step sa0531, the CPU reads the Ib=Ib (Vb) detected in step sa02 and stored in the RAM. The CPU then calculates the voltage difference Vs between the direct current voltages Vbmax and Vbmin corresponding to the maximum and minimum values of the direct current Ib respectively (i.e., Vs=Vbmax−Vbmin). The CPU also calculates the current difference D between the maximum value and the minimum value and H=Vs/D. The CPU stores the calculated results in the RAM. In step sa0532, the CPU reads the ration H stored in the RAM and the relation Vb=Vb (H) previously stored in the ROM. The CPU then compares the voltage difference H with the relation Vb=Vb (H). In step sa0533, the CPU calculates the appropriate value of the direct current voltage Vb. The process of calculating the appropriate direct current voltage Vb in step sa05 is then ended, and the process proceeds to step sa06.

Further, in the third exemplary embodiment, the process of warning on and stopping the operation of the developing device of step sb05 is different. In step sb02, the CPU reads the relation Ib=Ib (Vb) stored in the RAM. The CPU then calculates the voltage difference Vs between the direct current voltages Vbmax and Vbmin corresponding to the maximum and minimum values of the direct current Ib respectively (i.e., Vs=Vbmax−Vbmin). The CPU also calculates the current difference D between the maximum value and the minimum value and H=Vs/D. The calculated results are stored in the RAM. The CPU then compares the ratio H with the predetermined value Hk previously stored in the ROM, and when H is greater than or equal to Hk, the CPU warns the user on or stops the operation of the developing device. More specifically, appropriate predetermined values Hk1=16.5

[V/μA] (warning) and Hk2=20.0 [V/μA] (stopping) are calculated for warning and stopping timing by using a previously prepared developing device. The calculated values are then written in the ROM. The developing device for calculating the values of Hk1 and Hk2 is of a configuration similar to the developing device of the present exemplary embodiment. Further, the appropriate values are calculated by measuring the ratio H and evaluating the image when continuously printing at 5% image percentage.

Figure 21:
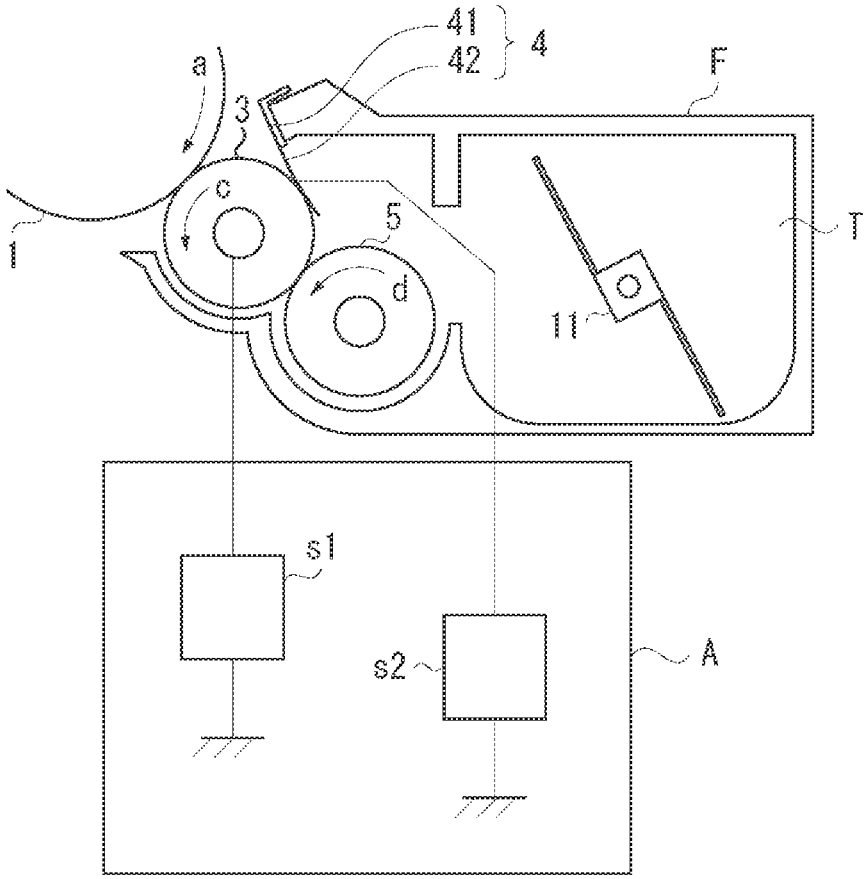
FIG. 21 illustrates the developing device and a portion of the image forming apparatus related to the developing device according to a comparative example 1.

The developing device and the portion of the image forming apparatus related to the developing device according to the comparative example 1 will be described below with reference to FIG. 21.

A mono-component non-magnetic toner is made using the suspension polymerization method involving binding resin and the charge-controlling agent. The toner is processed to be negatively charged by adding the fluidizer as the external additive.

A toner regulating member 4 controls the coating amount of the toner on the developing roller 3 to be a predetermined amount and the charge amount to be a predetermined amount appropriate for developing the latent image on the photosensitive drum 1. The toner regulating member 4 supports a sheet metal elastic member 42 such as a phosphor-bronze plate or a stainless plate on a supporting plate 41 fixed to the developing container on one end. The underside of the other end makes contact with the developing roller 3. In the present comparative example, a steel plate of thickness 1.2 mm is employed as the supporting plate 41, and the phosphor-bronze plate in thickness of 120 μm is fixedly supported on the supporting plate 41 as the sheet metal elastic member 42. The free length between the supporting portion of the sheet metal elastic member 42 at one end to the portion contacting the developing roller 3 is 14 mm, and the pushing amount of the developing roller 3 against the sheet metal elastic member 42 is 1.5 mm.

The image forming apparatus main assembly portion related to the developing device will be described below.

As described above, the power source s1 applies a voltage of −300 Von the developing roller 3. Further, the power source s2 applies a voltage of −500 V on the toner regulating member 4.

The comparative example 2 is basically similar to the first exemplary embodiment. The difference will be described below.

When the CPU calculates the appropriate value of Vb in step sa05 in the comparative example 2, the CPU uses a detected number of printed sheets R.

The process of calculating the direct current voltage Vb performed in step sa05 according to the comparative example 2 will be described in detail below.

Figure 22:
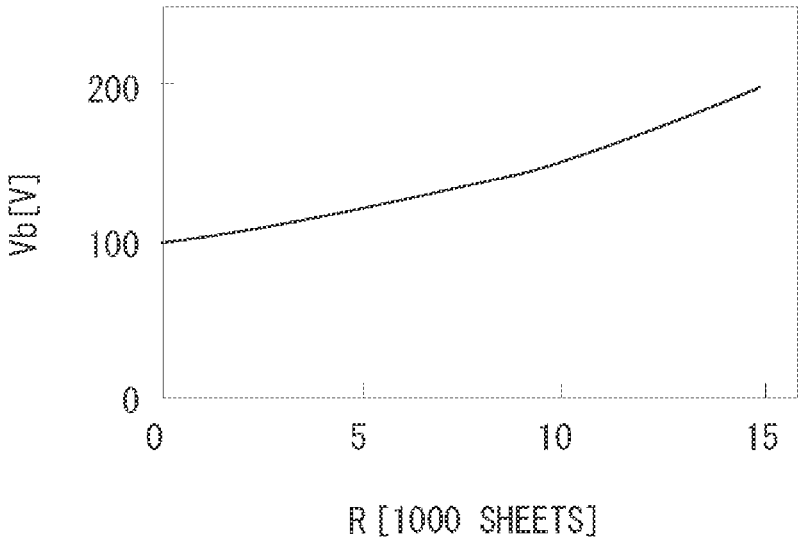
FIG. 22 illustrates a relation between a value of the number of printed sheets R and the direct current voltage Vb appropriate for acquiring a fine image by calculating Vb=Vb (R) according to a comparative example 2.

FIG. 22 illustrates a relation between the value of the number of printed sheets R and the appropriate direct current voltage Vb for acquiring a fine image as Vb=Vb (R).

The relation of Vb=Vb (R) is previously written in the ROM.

The developing device used in calculating the relation of Vb=Vb (R) is of a configuration similar to the developing device of the present comparative example. Further, the appropriate value of the direct current voltage Vb is calculated by measuring Vb and evaluating the image when continuously printing at 5% image percentage.

Figure 23:
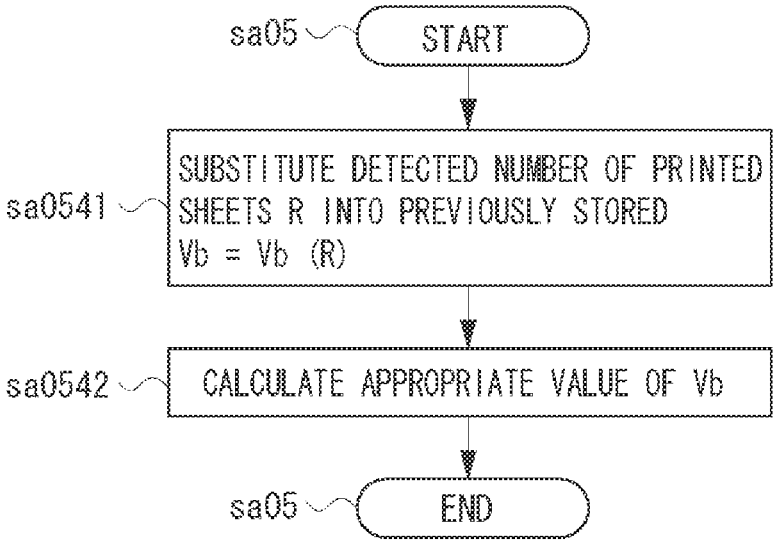
FIG. 23 is a flowchart illustrating a process for calculating the appropriate Vb according to the comparative example 2.

FIG. 23 is a flowchart illustrating the process of step sa05 according to the second exemplary embodiment. In step sa0541, the CPU reads the number of printed sheets R and Vb=Vb (R) previously stored in the ROM. The CPU then compares R with the relation Vb=Vb (R). In step sa0542, the CPU calculates the appropriate value of the direct current voltage Vb. The process of calculating the appropriate direct current voltage Vb in step sa05 is then ended, and the process proceeds to step sa06.

Further, the present comparative example does not perform the process of warning on and stopping the operation of the developing device, which is different from the first exemplary embodiment.

The comparative example 3 is basically similar to the first exemplary embodiment. The difference will be described below.

In the present comparative example, CPU calculates the appropriate value of the direct current voltage value Vb as Vbmin in step 05 illustrated in FIG. 5.

Further, the present comparative example does not perform the process of warning on and stopping the operation of the developing device which is different from the first exemplary embodiment. The appropriate value of Vb is calculated every time 2000 sheets are printed.

<<Method of Evaluating Each Exemplary Embodiment and Comparative Example>>

The image evaluation for checking the difference between the present exemplary embodiment and the comparative example will be described below.

a) Fog Evaluation after Durability Test 1 (Image Percentage: 5%)

The Fog is a sub-quality image feature appearing as background soiling in which the toner is developed by only a small amount on the white portion (unexposed portion) that is not to be printed.

Fog density is evaluated by measuring reflectivity using a reflectometer having a green filter (Reflectometer Model TC-6DS manufactured by Tokyo Denshoku Co.). The fog density is calculated by acquiring the reflectivity of the fogging portion as the difference between the reflectivity of the printed image and the reflectivity of the recording paper. A mean value of ten or more points is thus calculated on the recording paper.

E: Fog density is greater than 3.0%

D: Fog density is 1.0% or more and less than 3.0%

C: Fog density is 0.5% or more and less than 1.0%

B: Fog density is 0.2% or more and less than 0.5%

A: Fog density is less than 0.2%

The fog evaluation was conducted in a test environment at a temperature of 25° C., 50% Rh, and after printing 15,000 sheets. The print test was conducted when continuously printing a horizontal line recording image of 5% image percentage. More specifically, an image in which 1 dot printed line followed by 19 dot non-printed lines are repeated is used as the horizontal line recording image of 5% image percentage.

Further, when other image defects as will be described below are generated, fog density is measured by avoiding such portions, so that only the fog can be purely evaluated.

b) Fog Evaluation after Durability Test 2 (1% Image Percentage)

The measurement method and the evaluation criteria of the present fog evaluation are similar to the above-described evaluation. However, the print test was conducted when continuously printing a horizontal line recording image of 1% image percentage. More specifically, the present fog evaluation employs an image in which one dot printed line followed by 99 dot non-printed lines is repeated.

c) Fog Evaluation after Durability Test (1% Image Percentage and Intermittent Printing)

The measurement method and the evaluation criteria of the present fog evaluation are similar to the above-described evaluation. The print test is conducted when continuously printing a horizontal line recording image of 1% image percentage. More specifically, the present fog evaluation employs an image in which one dot printed line followed by 99 dot non-printed lines is repeated.

Further, intermittent printing is performed in the present invention. That is, the operation of the developing device is stopped after printing a specific number of sheets and printing is then continued. As a result, there is a time interval in which the developing device operates without printing directly after print start and print stop.

In the present evaluation, the developing device is stopped after continuously printing 2 sheets, after which the developing device again starts operating.

d) Vertical Stripes Evaluation

The vertical stripes evaluation is conducted by printing a solid black image and visually confirming whether there are vertical stripes.

A: less than two vertical stripes in the solid black image

B: two or more vertical stripes in the solid black image

The print test is conducted in a test environment at a temperature of 25° C., 50% Rh, and after printing 1,000 sheets. A horizontal line recording image having 5% image percentage is continuously printed.

The evaluation results of the first, second, and third exemplary embodiments and the first, second, and comparative example 3s are illustrated in Table 1 below.

TABLE 1

| | Setting method Of Vb | Fog Evaluation 1 | Fog Evaluation 2 | Fog Evaluation 3 | Vertical stripe |
|---|---|---|---|---|---|
| Embodiment 1 | According to D | B | B | C | A |
| Comparative Example 1 | Fixed at 200 V | D | E | E | A |
| Comparative Example 2 | According to no. of printouts | B | D | E | A |
| Comparative Example 3 | Vbmin = Vb | C | C | D | B |
| Embodiment 2 | According to Vs | B | B | B | A |
| Embodiment 3 | According to H = Vs/D | A | A | B | A |

<<Superiority Over Comparative Examples>>

The superiority of the first exemplary embodiment over the comparative example 1 will be described below. In the comparative example 1, the direct current voltage Vb previously applied between the developing roller and the regulating blade is set to a constant value of 200 V. The fog density after the durability test is larger in the comparative example 1. This is caused by the application of the direct current voltage Vb from when the number of printed sheets is small. When the direct current voltage Vb is applied between the developing roller and the regulating blade, the toner receives force in the direction of the developing roller at a contact nip where the developing roller is in contact with the regulating blade. In other words, in the comparative example 1, the toner receives stress applied by the direct current voltage Vb from when the number of printed sheets is small. As a result, the external additive becomes disengaged or embedded, which causes toner deterioration, and lowers chargeability. The fog density after the durability test thus increases.

On the other hand, in the first exemplary embodiment, the appropriate direct current voltage Vb is applied according to the value of the current difference D, i.e., toner deterioration. As a result, the excessive stress on the toner by applying the direct current voltage Vb from when the number of printed sheets is small is suppressed. Further, since the direct current voltage Vb is applied on the toner as necessary when toner deterioration progresses, the fog density can be greatly suppressed.

The superiority of the first, second, and third exemplary embodiments will be described below by comparing with the comparative examples 1, 2, and 3.

<Evaluation Results of a) Fog Evaluation after Durability Test 1; b) Fog Evaluation after Durability Test 2; and c) Fog Evaluation after Durability Test 3>

As described above, in the comparative example 1, a constant amount of the direct current voltage Vb is applied from when the number of printed sheets is small. The toner deterioration thus progresses, and the fog density increases.

In the comparative example 2, the appropriate direct current voltage Vb is applied according to the number of printed sheets R. The previously prepared relation Vb=Vb (R) is calculated by assuming printing at 5% image percentage. Therefore, the fog density after the durability test is greatly suppressed when printing at 5% image percentage after undergoing a durability test using an image percentage close to the previously assumed value. However, the fog density increases when the toner consumption is low by printing at 1% image percentage. The reason for this is that when the consumed amount of toner is low in the durability test, the amount of toner in the developing device at the time that R sheets are printed becomes greater than the assumed amount. If there is a large amount of toner in the developing device, the stress on the toner inside the developing device is basically averaged out, so that toner deterioration becomes small.

However, in the comparative example 2, the predetermined direct current voltage Vb is applied when a number of printed sheets is specified R even if toner deterioration is small. As a result, similarly as in the comparative example 1, an excessive direct current voltage Vb is applied when toner deterioration is small, so that stress is applied to the toner. The toner deterioration is thus promoted after the durability test in which the toner consumption is low, and the fog density increases.

On the other hand, in the first exemplary embodiment, the appropriate direct current voltage Vb is applied according to the value of the current difference D which reflects toner deterioration, regardless of the difference in the number of printed sheets and the consumed amount of toner. The increase in the fog density is thus suppressed.

Further, in the comparative example 3, the direct current voltage Vb is set to Vbmin, and the fog density is somewhat greater than in the first exemplary embodiment. The reason for this is that the direct current voltage Vb cannot be sufficiently applied to suppress the fog density when the chargeability is low due to toner deterioration. As a result, the fog density is slightly increased.

On the contrary, in the first exemplary embodiment, the value of the direct current voltage Vb to be applied is increased according to the value of the current difference D, i.e., the degree of toner deterioration. As a result, the promotion of toner deterioration is suppressed by reducing excessive application of the bias voltage. At the same time, a sufficient direct current voltage Vb can be applied to suppress the fog density when the chargeability is low due to toner deterioration.

From the above-described results, in the first exemplary embodiment, toner deterioration is greatly suppressed by applying the appropriate direct current voltage Vb according to the value of the current difference D reflecting toner deterioration. The appropriate direct current voltage Vb is applied regardless of the number of printed sheets and the consumed amount of toner. Additionally, the value of the direct current voltage Vb is increased according to the progress of toner deterioration, i.e., the decrease in the value of the current difference D. Therefore, sufficient direct current voltage Vb can be applied to suppress the fog density when the chargeability is low due to toner deterioration, and the fog density can be greatly suppressed.

The effects of the first, second, and third exemplary embodiments will be described below by comparing the exemplary embodiments with each other. The fog density is more suppressed in the second and third exemplary embodiments as compared to the first exemplary embodiment. In particular, the fog density is greatly suppressed when printing is intermittently performed at 1% image percentage so that the consumed amount of the toner is low. The reason is that, in the second and third exemplary embodiments, the accuracy of detecting toner deterioration is high. In such a case, the appropriate direct current voltage Vb can be set with higher accuracy, so that the fog density can be greatly suppressed. In particular, in the third exemplary embodiment, the cohesiveness of the toner corresponding to toner deterioration can be more correctly determined, so that the fog density suppression effect is great.

<Result of d) Vertical Stripe Evaluation>

In the comparative example 3, since the direct current voltage Vb is set to Vbmin, the vertical stripes are generated. As described above, when the direct current voltage Vb is set near Vbmin, there appear mixed states in which the toner is pressed against the developing roller (i.e., when the value is greater than Vbmin) and in which the number of times the regulating blade and the toner contacts is large (i.e., when the value is less than Vbmin). The toner coating layer then becomes unstable, and the vertical stripes are thus generated.

On the other hand, in the first, second, and third exemplary embodiments, the direct current voltage Vb is set to a value greater than Vbmin, and more desirably to Vb satisfying Vb>Vbmin+20 V. Therefore, it greatly suppresses the generation of vertical stripes in the solid black image due to the instability of the toner coating layer in the above-described mixed states.

As described above, in the first, second, and third exemplary embodiments, the direct current voltage Vb applied between the developing roller and the regulating blade are set to be greater than Vbmin. Vbmin is the voltage value corresponding to the minimum value of the current Ib flowing in the regulating blade, acquired from the relation of Ib=Ib (Vb). As a result, the toner coating layer is stabilized, and the vertical stripes are reduced.

Further, the appropriate direct current voltage Vb is applied regardless of the number of printed sheets and the consumed amount of toner. Furthermore, the value of the direct current voltage Vb is increased according to the progress of toner deterioration, i.e., the decrease in the value of the current difference D. The sufficient direct current voltage Vb can thus be applied to suppress the fog density when the chargeability is low due to toner deterioration, and the fog density can be greatly suppressed.

Furthermore, the above-described effects can be acquired over a long term using a simple configuration.

The developing device according to a fourth exemplary embodiment will be described in detail below.

Figure 19:
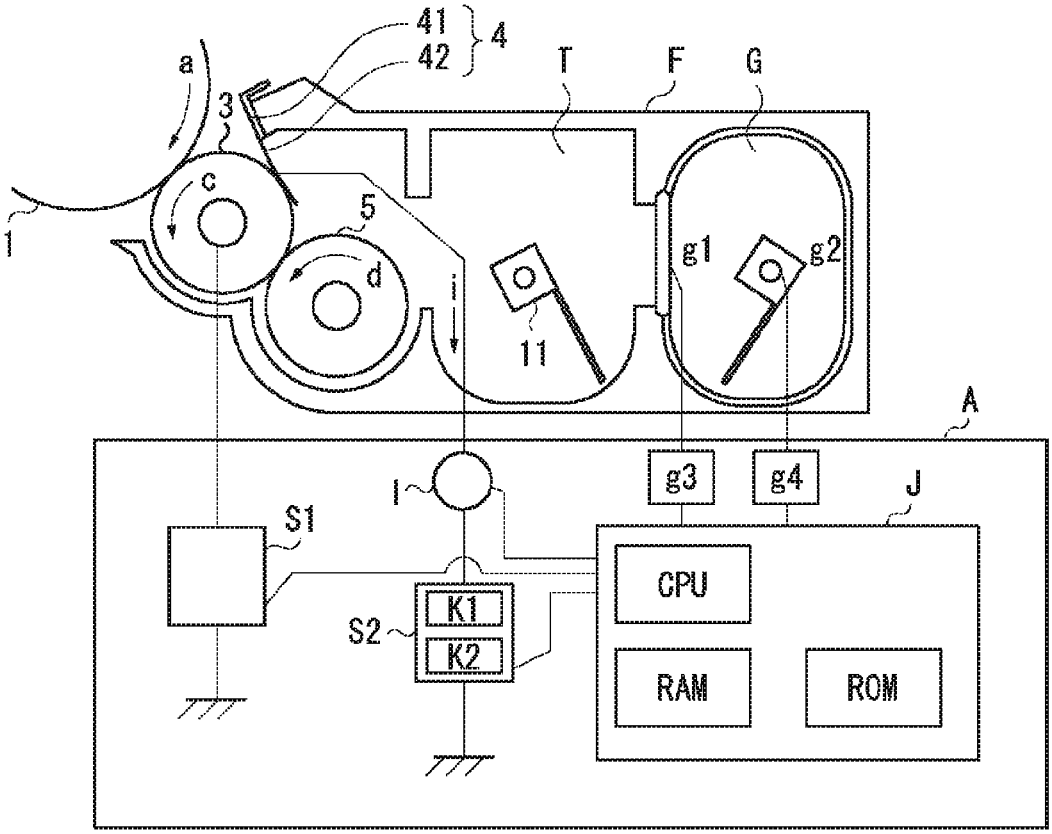
FIG. 19 illustrates a schematic view of a mechanism of the developing device and a portion of the image forming apparatus related to the developing device according to a fourth exemplary embodiment of the present invention.

FIG. 19 is a schematic diagram illustrating the developing device and the portion of the image forming apparatus related to the developing device according to the fourth exemplary embodiment. The differences from the first exemplary embodiment will be described below. The developing device in the fourth exemplary embodiment includes a developer replenishment unit G which is a toner replenishment unit, unlike the developing device of the first exemplary embodiment. The toner replenishment unit includes a valve g1 that can be opened and closed, and an agitating member g2. Further, the developer replenishment unit G is detachable, and the toner can be replenished as appropriate. Furthermore, since the toner is supplied to a toner container T at predetermined timing, a replenishment control unit g3 operates the valve g1 that can be opened and closed and the agitating member g2.

In the present exemplary embodiment, the toner replenishment unit G controls the replenishment timing using the toner replenishment control unit g3. However, the toner replenishment unit G which contains new toner can be manually replaced when replenishing the toner.

Further, in the present exemplary embodiment, toner capacity in an unused developing device corresponds to printing 5000 sheets of A4 paper at 5% printing percentage. Furthermore, the amount of toner in the developing device before replenishing the toner after printing 5,000 sheets is approximately 40% of the initial toner filling amount. Moreover, when replenishing the toner, an amount of approximately 50% of the initial toner filling amount is replenished.

Referring to FIG. 19, the power sources S1 and S2 are connected to the calculation processing unit J disposed in the image forming apparatus main assembly A. The image forming apparatus further includes the ammeter I which is a current detection unit for measuring the current Ib flowing in the regulating blade. The ammeter I is also connected to the calculation processing unit J and can transfer the detected data to the calculation processing unit J.

Further, the replenishment control units g3 and g4 that control the operation of the valve g1 and the agitating member g2 are connected to the calculation processing unit J. The toner replenishment unit G thus replenishes the toner in the toner container T at predetermined timing.

In the present exemplary embodiment, the direct current voltage Vb is fixed at a constant value of 200 V.

Figure 20:
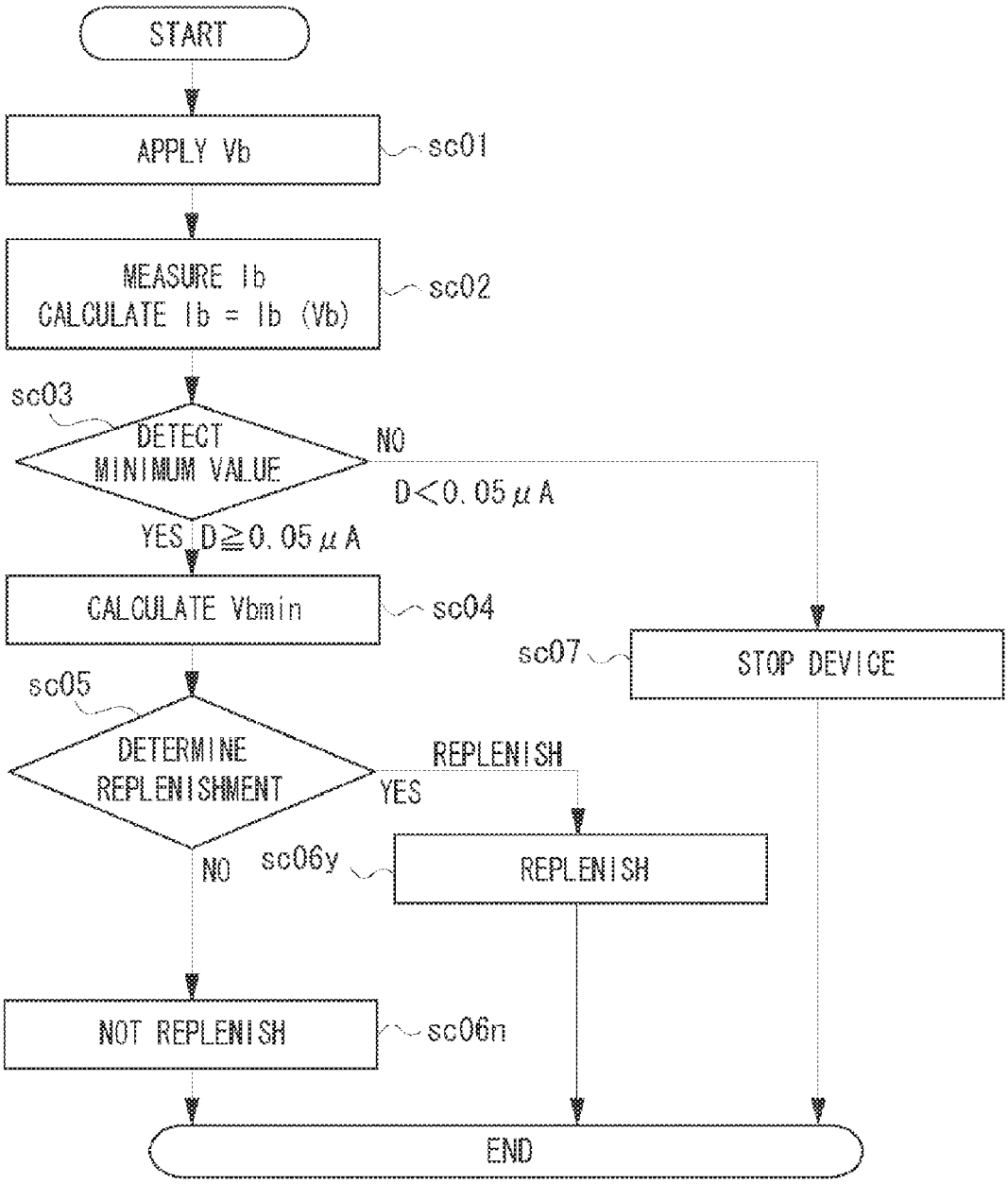
FIG. 20 is a flowchart illustrating a process of setting the direct current voltage Vb according to the fourth exemplary embodiment of the present invention.

The process of replenishing the toner will be described below. FIG. 20 is a flowchart illustrating the process of setting the direct current voltage Vb. Processes performed in step sc01 to step sc04 are similar to those in step sb01 to step sb04 in the process of warning on and stopping the operation of the developing device in the first exemplary embodiment illustrated in FIG. 12. In step sc05, the CPU determines whether to replenish the toner as will be described below. If the CPU determines to replenish the toner (YES in step Sc05), the process proceeds to step sc06*y*. In step sc06*y*, the replenishment control units g3 and g4 are activated, and the toner is replenished. The process then ends. On the other hand, if the CPU determines not to replenish the toner (NO in step Sc05), the process proceeds to step sc06*n*. In step sc06*n*, the replenishment control units g3 and g4 are not activated, and the process ends.

The process of determining the replenishment in step sc05 according to the present exemplary embodiment will be described below. As described in the first exemplary embodiment, the value of the current difference D decreases as toner deterioration progresses. For this reason, the CPU refers to the predetermined value Dh previously stored in the ROM, and if the current difference D at the time of replenishing the toner becomes less than or equal to Dh, the CPU determines to replenish the toner.

More specifically, the predetermined value Dh for determining the replenishment timing is calculated as Dh=2.0 μA using the previously prepared developing device. The value is written in the ROM.

The developing device used in calculating the value of Dh is of a configuration similar to the developing device of the present exemplary embodiment. The appropriate current difference Dh is calculated by continuously printing at 5% image percentage and measuring the current difference and evaluating the image when 5000 sheets are printed before replenishing the toner for the first time.

Further, in the present exemplary embodiment, the toner replenishing process is performed during a non-printing period when the image forming process is not performed.

More specifically, each process is performed every time 1000 sheets are printed. When the toner is replenished in the developing device, each process is performed at every 500 sheets printed after the replenishment, up to printing 2000 sheets. After printing 2000 sheets, each process is performed at every 1000 sheets printed.

The fifth exemplary embodiment is basically similar to the fourth exemplary embodiment. The difference is that the method of setting the direct current voltage Vb in the fifth exemplary embodiment is the same as the first exemplary embodiment.

The sixth exemplary embodiment is basically similar to the fourth exemplary embodiment. The process of determining whether to replenish the toner in step sc05 is different from the fourth exemplary embodiment.

In step sc05, the CPU reads the relation Ib=Ib (Vb) detected in step sc02 and stored in the RAM. The CPU then calculates the voltage difference Vs between the direct current voltages Vbmax and Vbmin corresponding to the maximum and minimum values of the direct current Ib respectively (i.e., Vs=Vbmax−Vbmin). The CPU then compares Vs with a predetermined value Vsh previously stored in the ROM. If Vs is greater than or equal to Vsh, the toner is replenished, which is different from the fourth exemplary embodiment. More specifically, a predetermined value of Vsh for determining the replenishment timing is calculated as Vsh=26 V using the previously prepared developing device. The value is written in the ROM.

The developing device used in calculating the value of Vsh is of a configuration similar to the developing device of the present exemplary embodiment. The appropriate voltage difference Vsh is calculated when continuously printing at 5% image percentage, and by the voltage difference Vs being measured and the image being evaluated when printing 5000 sheets before replenishing the toner for the first time.

Further, the method of setting the direct current voltage Vb in the sixth exemplary embodiment is the same as the second exemplary embodiment.

The seventh exemplary embodiment is basically similar to the fourth exemplary embodiment. The process of determining whether to replenish the toner in step sc05 is different from the fourth exemplary embodiment.

In step sc05, the CPU calculates the current difference D between the maximum value and the minimum value of the direct current Ib from the relation Ib=Ib (Vb). The CPU also calculates the voltage difference Vs between the direct current voltages Vbmax and Vbmin corresponding to the maximum and minimum values of the direct current Ib respectively. Further, the CPU calculates H=Vs/D. The CPU then compares H with a predetermined value Hh previously stored in the ROM. If H is greater than or equal to Hh, the toner is replenished, which is different from the fourth exemplary embodiment. More specifically, a predetermined value of Hh appropriate for the replenishment timing is calculated as Hh=13.0 [V/μA] using the previously prepared developing device. The value is written in the ROM.

The developing device used in calculating the value of Hh is of a configuration similar to the developing device of the present exemplary embodiment. The appropriate value of Hh is calculated when continuously printing at 5% image percentage, and by H being measured and the image being evaluated when printing 5000 sheets before replenishing the toner for the first time.

Further, the method of setting the direct current voltage Vb in the seventh exemplary embodiment is the same as the third exemplary embodiment.

The eighth exemplary embodiment is basically similar to the fourth exemplary embodiment. The process of determining whether to replenish the toner in step sc05 is different from the fourth exemplary embodiment and is the same as the sixth exemplary embodiment.

The ninth exemplary embodiment is basically similar to the fourth exemplary embodiment. The process of determining whether to replenish the toner in step sc05 is different from the fourth exemplary embodiment and is the same as the seventh exemplary embodiment.

A comparative example 4 is basically similar to the fourth exemplary embodiment. The difference is that in step sc05 of the comparative example 4, the toner is replenished when the number R of printed sheets becomes a predetermined value Rh. More specifically, the predetermined value Rh is set as Rh=5000 using a previously prepared developing device, and the value is written in the ROM.

A comparative example 5 is basically similar to the fifth exemplary embodiment and is different as described below.

In the process of determining whether to replenish the toner in step sc05, the toner is replenished if the ratio of the amount of the toner inside the developing device against the initial toner filling amount becomes a predetermined value Qh. More specifically, the predetermined value Qh is set as Qh=0.4 using a previously prepared developing device, and the value is written in the ROM.

<<Method of Evaluating Each Exemplary Embodiment and the Comparative Example>>

The image evaluation for checking the difference between the fourth exemplary embodiment and the comparative examples will be described below.

A) Fog Evaluation 1 Directly after Replenishing Toner (at 5% Image Percentage)

The determination criteria of the fog evaluation are similar to those of the fog evaluation after the durability test. The present fog evaluation is conducted at 25° C. and 50% Rh. Further, the toner replenishment unit operates to replenish the toner for the third time. After replenishing the toner, three pages of solid white image are continuously printed, and the evaluation image whose fog density is the greatest is evaluated.

The print test is conducted when continuously printing a horizontal line recording image of 5% image percentage. More specifically, an image is used in which 1 dot printed line followed by 19 dot non-printed lines is repeated as the horizontal recording image of 5% image percentage.

B) Fog Evaluation 2 Directly after Replenishing Toner (at 1% Image Percentage)

The measurement method and the evaluation criteria of the present fog evaluation are similar to the above-described evaluation 1. The present evaluation is different in conducting a print test when continuously printing a horizontal line recording image of 1% image percentage. More specifically, the image is used in which one dot printed line followed by 99 dot non-printed lines is repeated.

C) Amount of Toner Inside Developing Device Before Replenishing Toner (at 1% Image Percentage)

In the present evaluation, the amount of toner inside the developing device before the toner replenishment unit G replenishes the toner for the third time is measured. A ratio Q of the toner filling amount in the developing device at the initial unused state to the amount of toner inside the developing device is determined according to the criteria described below.

Large (L): ratio Q of the toner inside the developing device is greater than or equal to 1.0

Middle (M): ratio Q is 0.6 or greater and less than 1.0

Low (S): ratio Q is less than 0.6

An image is used in which one dot printed line followed by 99 dot non-printed lines is repeated as the horizontal line recording image of 1% image percentage.

D) Fog Evaluation after Durability Test and Replenishing Toner (at 1% Image Percentage)

The determination criteria for the present fog evaluation is the same as a) fog evaluation 1 after durability test described above. The present fog evaluation is conducted at 25° C. and 50% Rh test environment. Further, the print test is conducted when 5000 sheets have been continuously printed after the toner replenishment unit replenishes the toner for the third time. Furthermore, an image is used in which one dot printed line followed by 99 dot non-printed lines is repeated as the horizontal line recording image of 1% image percentage.

The evaluation results of the fourth, fifth, sixth, seventh, eighth, and ninth exemplary embodiments and the comparative examples 4 and 5 are illustrated in Table 2.

TABLE 2

| | Replenishment timing | Vb setting method | A) | B) | C) | D) |
|---|---|---|---|---|---|---|
| Embodiment 4 | Current Difference D becomes Dh | 200 V fixed | B | C | M | D |
| Comparative Example 4 | Number of printed sheets R becomes Rh | 200 V fixed | B | B | L | D |
| Comparative Example 5 | Remaining amount of toner Q becomes Qh | 200 V fixed | B | D | S | D |
| Embodiment 5 | Current Difference D becomes Dh | Current Difference D becomes Dh | B | C | S | C |
| Embodiment 6 | According to Vs | According to Vs | A | B | S | B |
| Embodiment 7 | According to H = Vs/D | According to H = Vs/D | A | A | S | A |
| Embodiment 8 | According to Vs | 200 V fixed | B | C | M | D |
| Embodiment 9 | According to H = Vs/D | 200 V fixed | B | C | M | D |

The comparison between the advantages of the effects of the fourth, fifth, sixth, seventh, eighth, and ninth exemplary embodiments and the comparative examples 4 and 5 will be described below.

<A) Fog Evaluation 1 Directly after Replenishing the Toner;

B) Fog Evaluation 2 Directly after Replenishing the Toner; and

C) Amount of Toner Inside Developing Device Before Toner Replenishment>

The fourth exemplary embodiment is compared with the comparative examples 4 and 5 as described below.

In the fourth exemplary embodiment and the comparative examples 4 and 5, the timing of replenishing the toner is previously set based on continuous printing of 5% image percentage. The fog density directly after replenishing the toner when continuously printing at 5% image percentage is thus small and a fine image is formed.

In the comparative example 4, the toner is replenished when the number of printed sheets R reaches the predetermined number of printed sheets Rh. The fog density does not increase directly after the toner is replenished even if the toner consumption amount is small at 1% image percentage, and a fine image is achieved. However, there is a large amount of toner in the developer container directly before replenishing the toner, so that the toner tends to remain in the developer container.

The reason for this is that when printing is continued while the toner consumption amount is low, the toner replenishment unit replenishes the toner even if a large amount of toner is remaining inside the developer container. As a result, toner deterioration is suppressed, and an increase in the fog density when the toner is replenished is also suppressed. However, the amount of toner inside the developing device becomes large, which is not favorable as there is an increase in wasted toner from the view of efficient toner consumption. Further, the toner is repeatedly replenished, so that the amount of toner inside the developer container exceeds the normal amount, and powder pressure inside the developer container greatly increases. As a result, toner deterioration is promoted, and the fog density may increase regardless of the large amount of toner. Alternatively, the toner inside the developer container in which the powder pressure has risen may be dispersed to the outside of the developer container, leak, or generate soiling of the main assembly.

On the other hand, in the comparative example 5, the toner is replenished when the ratio Q of the remaining amount of toner in the developer container becomes the predetermined value Qh, even if the toner consumption amount is low at 1% image percentage. The amount of toner inside the developer container is thus small before replenishing the toner. However, since printing is continued while the amount of toner is small, the toner receives stress by sliding and rubbing with the developing roller and the photosensitive drum, the developing roller and the supply roller, and the developing roller and the toner regulating member. The toner is thus greatly deteriorated. In such a state, the toner replenishment unit mixes the new toner with the toner inside the developer container, so that the fog density is greatly increased. The reason for the increase in the fog density will be described below.

When toner deterioration has progressed, the cohesiveness of the toner increases and the chargeability is lowered. On the other hand, in the new toner, the cohesiveness is low and the chargeability is high. When such toners of different characteristics are mixed, the new toner that is easily chargeable tends to generate a greater charge amount. In contrast, the deteriorated toner which is difficult to be charged generates a less charge amount or generates toner that is charged to an opposite polarity. As a result, if the toner coating layer is dominated by charged toner which is difficult to be electrically controlled, the fog density greatly increases.

More specifically, it is important to supply the new toner before toner deterioration exceeds a predetermined value. As a result, the amount of toner in the developing device before the toner is replenished can be kept small, and the fog density directly after the replenishment of the toner can be suppressed.

In the fourth exemplary embodiment, the toner replenishment unit replenishes the toner when the current difference D related to toner deterioration becomes less than or equal to the predetermined value Dh. A drastic increase in the fog density directly after the toner is replenished is thus suppressed even if the toner consumption amount is small at 1% image percentage.

Further, since the toner is not replenished until the current difference D becomes less than or equal to the predetermined value Dh, the increase in the amount of toner inside the developing device can be suppressed.

As described above, in the fourth exemplary embodiment, the toner is replenished when the current difference D related to toner deterioration becomes less than or equal to the predetermined value Dh. As a result, it suppresses mixing of the greatly deteriorated toner with the new toner, and an increase in the fog density directly after replenishing the toner is suppressed.

Further, the toner is not replenished until toner deterioration progresses to a certain amount even if printing is performed with a small toner consumption amount. The drastic increase in the amount of toner in the developing device is thus suppressed.

In other words, in the fourth exemplary embodiment, the increase in the amount of toner in the developing device before replenishing the toner and the fog density after replenishing the toner, are suppressed regardless of the toner consumption amount.

The fifth, sixth, seventh, eighth, and ninth exemplary embodiments are compared with the fourth exemplary embodiment to describe the advantageous effects.

In the fifth exemplary embodiment, the value of the direct current voltage Vb is set according to the value of the current difference D reflecting toner deterioration. As described above as the effect of the first exemplary embodiment, since the direct current voltage Vb is set according to toner deterioration, the excessive stress on the toner by applying the direct current voltage Vb can be reduced, and toner deterioration can be suppressed. As a result, the fog density when the toner is replenished when printing at 1% image percentage is at the same level as the fog density in the fourth exemplary embodiment. However, the amount of toner in the developing device before the toner is replenished can be greatly suppressed.

On the other hand, as compared to the fifth exemplary embodiment, the sixth and seventh exemplary embodiments can detect toner deterioration with higher accuracy. The replenishment timing and the direct current voltage Vb can thus be more appropriately set. As a result, the increase in the fog density directly after the toner is replenished can be greatly suppressed even if the amount of toner in the developer container is small before the toner is replenished. In particular, in the ninth exemplary embodiment, the cohesiveness of the toner corresponding to toner deterioration can be more accurately determined, so that the fog density directly after the toner is replenished can be greatly suppressed.

Further, the eighth and ninth exemplary embodiments produce the same effect as the fourth exemplary embodiment.

<Result of D) Fog Evaluation after Durability Test and Replenishing the Toner>

The fifth, sixth, and seventh exemplary embodiments are compared with the fourth exemplary embodiment to describe the advantageous effects. As compared to the fourth exemplary embodiment, the fifth, sixth, and seventh exemplary embodiments can suppress the fog density after the durability test after the toner is replenished.

The reason for the above is as follows. The direct current voltage Vb is set according to toner deterioration similar to the first, second, and third exemplary embodiments. An appropriate direct current voltage Vb can thus be applied to suppress the excessive stress and the fog density when the toner is deteriorated.

Further, when the toner is replenished in the fourth exemplary embodiment, toner deterioration can be suppressed by the effect described below. Since adequately deteriorated toner is dominant inside the developer container before the toner is replenished, the direct current voltage Vb is set to be a comparatively large value. When the toner is replenished, the moderately deteriorated toner is dominant near the regulating blade. The direct current voltage Vb is thus large. If printing is continued after the toner is replenished, the replenished toner is dominant near the regulating blade. In such a case, the current difference D reflecting toner deterioration is greater as compared to the one directly after the toner is replenished, so that the value of the direct current voltage Vb becomes small.

In other words, in the fifth, sixth, and seventh exemplary embodiments, when toner with little deterioration is dominant inside the developer container after replenishing the toner, the value of the direct current voltage Vb can be set small. As a result, toner deterioration can be greatly suppressed.

In the sixth and seventh exemplary embodiments, the detection accuracy of toner deterioration is high, so that toner deterioration can be more suppressed, and the fog density after the durability test and replenishment of the toner can be greatly suppressed.

In particular, since the seventh exemplary embodiment can more accurately determine the cohesiveness of the toner corresponding to toner deterioration, the fog density after the durability test and replenishment of the toner can be greatly suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-228322 filed Sep. 5, 2008, which is hereby incorporated by reference herein in its entirety.

What is claimed is:

1. An image forming apparatus comprising:

a developer bearing member configured to bear a developer to develop a latent image formed on an image bearing member;

a developer regulating member configured to regulate an amount of the developer carried on the developer bearing member;

a voltage application unit that can apply a plurality of direct current voltages of different values between the developer bearing member and the developer regulating member; and a current detection unit that can detect a direct current flowing in the developer regulating member, wherein the image forming apparatus is capable of executing a detection control operation to cause the current detection unit to detect a change of the direct current flowing in the developer regulating member while changing a value of the direct voltage applied by the voltage application unit when the latent image is not being developed, and wherein the image forming apparatus sets a direct current voltage value Vb applied by the voltage application unit when developing the latent image after executing the detection control operation, so that the following expression is satisfied: $|Vb|>|Vbmin|$, where Vbmin is a direct current voltage value being applied by the voltage application unit when the detection control operation is executed and the direct current voltage detected by the detection unit is a minimum value.

2. The image forming apparatus according to claim 1, wherein Vb is set to satisfy the following expression:

$$|Vb|>|Vb\min|+20\text{ V}.$$

3. The image forming apparatus according to claim 1, wherein Vb is set to satisfy the following expression:

$|\Delta Ib(Vb)|\leqq 10\times|\Delta Ib(Vbmin)|$, where Ib (Vb) is a value of a direct current detected by the current detecting unit when Vb is the direct current voltage applied by the voltage application unit when developing the latent image, and ΔIb (Vb) is a range of fluctuation of the value of the direct current.

4. An image forming apparatus comprising:

a developer bearing member configured to bear a developer to develop a latent image formed on an image bearing member;

a developer regulating member configured to regulate an amount of the developer carried on the developer bearing member;

a voltage application unit that can apply a plurality of direct current voltages of different values between the developer bearing member and the developer regulating member; and a current detection unit that can detect a direct current flowing in the developer regulating member, wherein the image forming apparatus is capable of executing a detection control operation to cause the current detection unit to detect a change of the direct current flowing in the developer regulating member while changing a value of the direct voltage applied by the voltage application unit when the latent image is not being developed, and wherein the image forming apparatus sets a direct current voltage value Vb applied by the voltage application unit, when developing the latent image after executing the detection control operation, based on D, where D is a difference in a maximum value and the minimum value of the direct current to be detected by the current detection unit when the detection control operation is executed.

5. The image forming apparatus according to claim 4, wherein |Vb| is set larger as D becomes smaller.

6. An image forming apparatus comprising:

a developer bearing member configured to bear a developer to develop a latent image formed on an image bearing member;

a developer regulating member configured to regulate an amount of the developer carried on the developer bearing member;

a voltage application unit that can apply a plurality of direct current voltages of different values between the developer bearing member and the developer regulating member;

a current detection unit that can detect a direct current flowing in the developer regulating member; and a notification unit configured to notify information related to a status of a developer between the developer bearing member and the developer regulating member wherein the image forming apparatus is capable of executing a detection control operation to cause the current detection unit to detect a change of the direct current flowing in the developer regulating member while changing a value of the direct voltage applied by the voltage application unit when the latent image is not being developed, and wherein the notification unit notifies the information based on the direct current to be detected when the detection control operation is executed.

7. The image forming apparatus according to claim 6, wherein the information is notified based on D where D is a difference in a maximum value and the minimum value of the direct current to be detected by the current detection unit when the detection control operation is executed.

8. The image forming apparatus according to claim 6, wherein the information is notified based on Vs where Vs is a difference between direct voltages values applied by the voltage application unit when the detection control operation is executed and the current detection unit detects a minimum value and a maximum value of the plurality of direct currents.

9. The image forming apparatus according to claim 6, wherein the information is notified based on Vs / D (=H), where D is a difference in a maximum value and the minimum value of the direct current to be detected by the current detection unit when the detection control operation is executed, and Vs is a difference between direct voltages values applied by the voltage application unit when the detection control operation is executed and the current detection unit detects a minimum value and a maximum value of the direct current.

10. The image forming apparatus according to claim 6, wherein the information is warning information for warning on deterioration of the developer.

11. An image forming apparatus comprising:

a developer bearing member configured to bear a developer to develop a latent image formed on an image bearing member;

a developer regulating member configured to regulate an amount of the developer carried on the developer bearing member;

a developer containing unit configured to contain a developer to be supplied to the developer bearing member;

a developer replenishment unit configured to replenish a developer to the developer containing unit;

a voltage application unit that can apply a plurality of direct current voltages of different values between the developer bearing member and the developer regulating member;

a current detection unit that can detect a direct current flowing in the developer regulating member; and a replenishment control unit configured to control replenishment of a developer to the developer containing unit from the developer replenishment unit wherein the image forming apparatus is capable of executing a detection control operation to cause the current detection unit to detect a change of the direct current flowing in the developer regulating member while changing a value of the direct voltage applied by the voltage application unit when the latent image is not being developed, and wherein the replenishment control unit controls the replenishment of the developer based on the direct current to be detected by the current detection unit when the detection control operation is executed.

12. The image forming apparatus according to claim 11, wherein replenishing of a developer is controlled based on D, where D is a difference in a maximum value and the minimum value of the direct current to be detected by the current detection unit when the detection control operation is executed.

13. The image forming apparatus according to claim 11, wherein replenishment of a developer is controlled based on Vs, where Vs is a difference between direct voltages values applied by the voltage application unit when the detection control operation is executed and the current detection unit detects a minimum value and a maximum value of the direct current.

14. The image forming apparatus according to claim 11, wherein replenishment of a developer is controlled based on Vs / D (=H), where D is a difference in a maximum value and the minimum value of the direct current to be detected by the current detection unit when the detection control operation is executed, and Vs is a difference between direct voltages values applied by the voltage application unit when the detection control operation is executed and the current detection unit detects a minimum value and a maximum value of the direct current.

15. An image forming system comprising:

a developer bearing member configured to bear a developer to develop a latent image formed on an image bearing member;

a developer regulating member configured to regulate an amount of the developer carried on the developer bearing member;

a voltage application unit that can apply a plurality of direct current voltages of different values between the developer bearing member and the developer regulating member;

a current detection unit that can detect a direct current flowing in the developer regulating member; and a notification unit configured to notify information related to a status of a developer between the developer bearing member and the developer regulating member wherein the image forming apparatus is capable of executing a detection control operation to cause the current detection unit to detect a change of the direct current flowing in the developer regulating member while changing a value of the direct voltage applied by the voltage application unit when the latent image is not being developed, and wherein the notification unit notifies the information based on the direct current to be detected by the current detection unit when the detection control operation is executed.

16. The image forming system according to claim 15, wherein the information is notified based on D, where D is a difference in a maximum value and the minimum value of the direct current to be detected by the current detection unit when the detection control operation is executed.

17. The image forming system according to claim 15, wherein the information is notified based on Vs, where Vs is a difference between direct voltages values applied by the voltage application unit when the detection control operation is executed and the current detection unit detects a minimum value and a maximum value of the direct current.

18. The image forming system according to claim 15, wherein the information is notified based on Vs / D (=H), where D is a difference in a maximum value and the minimum value of the direct current to be detected by the current detection unit when the detection control operation is executed, and Vs is a difference between direct voltages values applied by the voltage application unit when the detection control operation is executed and the current detection unit detects a minimum value and a maximum value of the direct current.

19. The image forming system according to claim 15, wherein the information is warning information for warning on deterioration of the developer.

* * * * *